US008528304B2

(12) United States Patent
Miyazaki et al.

(10) Patent No.: US 8,528,304 B2
(45) Date of Patent: Sep. 10, 2013

(54) METHOD AND DEVICE FOR PRODUCING CONTENT FILLING BOTTLE

(75) Inventors: Shunzo Miyazaki, Saitama (JP); Yasuhiro Sato, Saitama (JP); Akio Watanabe, Gunma (JP); Masaru Kimura, Gunma (JP)

(73) Assignee: Graham Packaging Company, L.P., York, PA (US)

( * ) Notice: Subject to any disclaimer, the term of this patent is extended or adjusted under 35 U.S.C. 154(b) by 332 days.

(21) Appl. No.: 12/308,081

(22) PCT Filed: Jun. 26, 2007

(86) PCT No.: PCT/JP2007/062747

§ 371 (c)(1),
(2), (4) Date: Dec. 5, 2008

(87) PCT Pub. No.: WO2008/004458

PCT Pub. Date: Jan. 10, 2008

(65) Prior Publication Data

US 2009/0293436 A1 Dec. 3, 2009

(30) Foreign Application Priority Data

Jul. 3, 2006 (JP) ..... 2006-183197
Jul. 3, 2006 (JP) ..... 2006-183198

(51) Int. Cl.
*B67C 7/00* (2006.01)
*B67C 3/24* (2006.01)

(52) U.S. Cl.
USPC ..... 53/440; 53/471; 53/127; 53/281

(58) Field of Classification Search
CPC ..... B67C 7/00; B67C 3/242
USPC ..... 53/440, 471, 490, 127, 266.1, 272, 53/281, 282, 283, 287, 300, 317, 367; 141/11, 141/82
IPC ..... B67C 3/24,7/00
See application file for complete search history.

(56) References Cited

U.S. PATENT DOCUMENTS 3,577,698 A * 5/1971 Ruekberg ..... 53/471
3,998,030 A * 12/1976 Straub ..... 53/471

(Continued)

FOREIGN PATENT DOCUMENTS

DE 2102319 8/1972
JP 6-72423 A 3/1994

(Continued)

OTHER PUBLICATIONS

EPO machine translation of DE 2102319, retrieved from espacenet.com, Apr. 23, 2013, 6 pages.*

(Continued)

*Primary Examiner* — Stephen F Gerrity
(74) *Attorney, Agent, or Firm* — Stradley Ronon Stevens & Young, LLP

(57) ABSTRACT

The present invention provides a method and device for producing a content filling bottle including a bottom part that is inverted between a concave shape and a convex shape to prevent a body part from being subjected to reduced pressure deformation, the method and device being capable of efficiently producing a sanitary and high-quality content filling bottle. Contents are filled into an empty bottle 1 with an inversion part 11 projecting outwardly from the body part. A cap 6 is fitted onto an opening of the bottle 1 to seal the bottle 1. An auxiliary tool 27 is then installed on the bottom part 5 of the bottle 1. Then, the bottom part of the bottle 1 with the auxiliary tool 27 installed thereon is supported via the auxiliary tool 27. The downwardly projecting inversion part 11 is pressed up so as to be inverted and recessed inwardly into the bottle 1. Subsequently, with the opening of the bottle 1 gripped, the auxiliary tool 27 is separated from the bottle 1.

10 Claims, 20 Drawing Sheets

(56) References Cited

U.S. PATENT DOCUMENTS

| | | | | | |
|---|---|---|---|---|---|
| 4,293,359 | A | * | 10/1981 | Jakobsen | 156/156 |
| 4,338,765 | A | * | 7/1982 | Ohmori et al. | 53/471 |
| 4,510,737 | A | * | 4/1985 | Ellert | 53/570 |
| 4,967,538 | A | * | 11/1990 | Leftault et al. | 53/440 |
| 5,090,180 | A | * | 2/1992 | Sorensen | 53/471 |
| 5,251,424 | A | * | 10/1993 | Zenger et al. | 53/431 |
| 5,407,086 | A | | 4/1995 | Ota et al. | |
| 5,437,361 | A | * | 8/1995 | Ohmori et al. | 198/465.1 |
| 2003/0217947 | A1 | * | 11/2003 | Ishikawa et al. | 206/583 |
| 2004/0149677 | A1 | * | 8/2004 | Slat et al. | 215/380 |
| 2006/0006133 | A1 | * | 1/2006 | Lisch et al. | 215/374 |
| 2006/0138074 | A1 | * | 6/2006 | Melrose | 215/373 |
| 2006/0255005 | A1 | * | 11/2006 | Melrose et al. | 215/381 |
| 2007/0181403 | A1 | * | 8/2007 | Sheets et al. | 198/617 |
| 2009/0218003 | A1 | * | 9/2009 | Miyazaki et al. | 141/4 |

FOREIGN PATENT DOCUMENTS

| | | | | |
|---|---|---|---|---|
| JP | 08-282789 | A | | 10/1996 |
| JP | 2001-97486 | A | | 4/2001 |
| JP | 2005041496 | A | * | 2/2005 |
| JP | 2006-501109 | A | | 1/2006 |
| WO | WO-2004/028910 | A1 | | 4/2004 |
| WO | WO-2005/012091 | A2 | | 2/2005 |
| WO | WO 2006/068511 | A | | 6/2006 |

OTHER PUBLICATIONS

JPO machine translation of JP 2001-97486, retrieved from ipdl.inpit.go.jp, Apr. 23, 2013, 3 pages.*

* cited by examiner

METHOD AND DEVICE FOR PRODUCING CONTENT FILLING BOTTLE

TECHNICAL FIELD

The present invention relates to a method and device for producing a content filling bottle, and more specifically, to a method for producing a content filling bottle by filling liquid contents into a synthetic resin bottle having a bottom part formed to partly project outwardly in an axial direction of a body part so that the projecting part can be inverted and recessed inwardly into the body part, along with a device for carrying out the method.

BACKGROUND ART

As a content filling bottle, which accommodates liquid contents such as a drink therein, for example, a bottle (PET bottle) made by blow forming a polyethylene-terephthalate material has been known.

With this type of bottle, when an opening of the bottle is hermetically sealed with a cap and the contents of the bottle are then cooled, a decrease in the volume of the contents or the like reduces the pressure in the bottle. This may deform a body part of the bottle, making the appearance of the bottle unfavorable.

Therefore, a plurality of flexible panels are formed on the body part to evenly absorb the deformation accompanying the internal pressure reduction caused by the cooling of the contents after filling (see, for example, Japanese Patent Laid-Open No. 6-72423). However, the provision of such panels complicates the shape of the bottle, thus increasing the material cost for the bottle.

Consequently, in a known device, a portion of the bottom part of the bottle can be inverted between a concave shape and a convex shape so that the liquid contents are filled into the bottle with the inversion part projecting outwardly from the bottom and so that after the bottle opening is sealed with the cap, the inversion part is recessed inwardly into the bottle (National Publication of International Patent Application No. 2006-501109).

Thus, with the bottle described in National Publication of International Patent Application No. 2006-501109, prior to filling of the liquid contents into the bottle, the inversion part of the bottom part of the bottle is pressed out so as to project outwardly from the body part.

Then, liquid contents are filled into the interior of the bottle with the inversion part of the bottom part projecting outwardly from the body part. The opening of the bottle is then sealed with the cap.

Thereafter, the outwardly projecting inversion part of the bottom part of the bottle is pressed up toward the interior of the bottle so as to be recessed inwardly into the bottle. Thus, the pressure inside the bottle increases. As a result, even when a pressure reduction results from, for example, the cooling of the liquid contents, the pressure reduction is canceled by the above-described pressure increase, preventing the body part of the container from being subjected to reduced pressure deformation.

In this manner, the inversion part, which can be inverted between the concave and convex shapes, is formed in the bottom part of the bottle and inverted in the stage of produce of the content filling bottle. This eliminates the need to provide the body part of the bottle with a panel that evenly absorbs such deformation as described above. This in turn enables an increase in the degree of freedom of bottle design and a reduction in the material costs of the bottle.

However, with the bottle that prevents the reduced pressure deformation of the body part by the concave and convex inversion of the bottom part of the bottle, the inversion part of the bottom part of the bottle needs to be projected outwardly from the body part before filling of the contents. This makes the bottom part of the bottle unstable and thus makes it difficult to transport the bottle in a self-standing state.

Therefore, a cylindrical auxiliary tool having a stable ground portion to assist in making the bottle self-standing is installed in the bottom part of the bottle so that the inversion part of the bottom part can be accommodated in the auxiliary tool. Then, regardless of whether the inversion part is in the concave or convex state, the bottle can be stood upright via the auxiliary tool. As a result, stable self-standing transportation can be carried out.

However, for example, if heated contents are filled into the bottle (what is called hot filling), then before the filling of the contents, the bottle is turned upside down and washed with washing water. However, when the bottle with the auxiliary tool installed therein is turned upside down for washing, the washing water stuck on the auxiliary tool flows down to the opening of the bottle. This makes the bottle unsanitary.

If contents at the ordinary temperature are filled into the bottle (what is called aseptic filling), the bottle is used of which an inner surface and an outer surface are sterilized and the filling operation is performed in a sterile state. In this case, to remain installed in the bottle, the auxiliary tool needs to be subjected to a sterilization treatment or the like. This increases the number of operation man-hours, thereby reducing efficiency.

DISCLOSURE OF THE INVENTION

The present invention has been devised taking into account the aforementioned problems. An object of the present invention is to provide a method and device for producing a content filling bottle which method and device, in producing a content filling bottle that prevents reduced pressure deformation of a body part by concave and convex inversion of a bottom part, can efficiently produce a sanitary and high-quality content filling bottle and which method and device is suitable not only for what is called hot filling involving filling of heated contents but also for what is called aseptic filling involving contents at the ordinary temperature.

The present invention relates to a method and device for producing a content filling bottle, in which liquid contents are sealed inside a synthetic resin bottle. The present invention adopts a bottle comprising a hollowed body part, an opening formed at an upper end of the body part and onto which a cap is capable of being fitted, a bottom part closing a lower end of the body part, and an inversion part formed in a portion of the bottom part so as to project outwardly from the body part in the axial direction of the body part, the inversion part being capable of being inverted and recessed inwardly into the body part in the axial direction thereof.

In an aspect of a method according to the present invention for accomplishing the object, first, a content filling step and a sealing step are carried out; in the content filling step, liquid contents are filled into an interior of the empty bottle with the inversion part projecting outwardly from the body part and with the contents not filled therein yet, and in the sealing step, the cap is fitted onto the opening of the filled bottle with the liquid contents filled therein in the content filling step to seal the bottle. In the content filling step, the contents heated to a predetermined temperature may be filled into the empty bottle (what is called hot filling) or the contents at the ordinary temperature may be filled into the empty bottle (what is called aseptic filling). Then, an auxiliary tool installing step is carried out; in the auxiliary tool installing step, a cylindrical auxiliary tool is installed on an outer periphery of the bottom part of the filled bottle with the cap fitted thereon in the sealing step, the auxiliary tool being shaped so as to be capable of being mounted on and removed from the bottom part of the bottle, and the lower portion of the bottom part corresponding to the inversion part being open. A bottom part recessing step is then carried out; in the bottom part recessing step, the bottom part of the filled bottle with the auxiliary tool installed thereon in the auxiliary tool installing step is supported via the auxiliary tool, and the downwardly projecting inversion part is pressed up so as to be inverted and recessed inwardly into the bottle. Then, an auxiliary tool separating step is carried out; in the auxiliary tool separating step, the auxiliary tool is separated from the filled bottle with the inversion part recessed inwardly into the body part in the bottom part recessing step.

The method according to the present invention is characterized by carrying out the auxiliary installing step after the sealing step. Thus, during the content filling step, the auxiliary tool is not installed on the bottle. Consequently, washing of the bottle, which is performed for the hot filling, can be achieved acceptably sanitarily. For the aseptic filling, the need for a sterilization treatment for the auxiliary tool is eliminated, preventing an increase in the number of operation steps. The filling and sealing operations can thus be efficiently performed.

Moreover, the bottom part recessing step is carried out after the auxiliary tool has been installed on the bottle in the auxiliary tool installing step. Thus, the auxiliary tool prevents the bottom part of the bottle from being subjected to inadvertent deformation or the like, and allows the inversion part to be reliably invented and recessed inwardly into the bottle. This prevents the bottom part of the bottle from being improperly deformed. A high-quality content filling bottle can thus be produced.

In another aspect of the method according to the present invention for accomplishing the object, a content filling step and a sealing step are carried out; in the content filling step, liquid contents are filled into an interior of the empty bottle with the inversion part projecting outwardly from the body part and with the contents not filled therein yet, and in the sealing step, the cap is fitted onto the opening of the filled bottle with the liquid contents filled therein in the content filling step to seal the bottle. In the content filling step, the contents heated to a predetermined temperature may be filled into the empty bottle (what is called hot filling). However, in particular, this step is suitably used when the contents at the ordinary temperature are filled into the empty bottle (what is called aseptic filling). Then, a bottle retaining step is carried out; in the bottle retaining step, an upper portion of the body part of the filled bottle with the cap fitted thereon in the sealing step and a shoulder part of the filled bottle, which is continuous with the opening, are gripped to retain the filled bottle so that the bottle is inhibited from moving in a vertical direction. A bottom part recessing step is then carried out; in the bottom part recessing step, with the state of the filled bottle retained in the bottle retaining step maintained, the inversion part of the bottom part of the filled bottle is pressed up so as to be inverted and recessed inwardly into the bottle.

The method according to the present invention is characterized in that in the bottle retaining step, the upper portion of the body part and the shoulder part of the filled bottle are gripped to retain the filled bottle so that the filled bottle is inhibited from moving in the vertical direction, and this state is maintained when the inversion part of the bottom part of the filled bottle is inverted and recessed inwardly into the bottle in the bottom part recessing step. Thus, the inversion part can be inverted and recessed inwardly into the bottle without the need to make the bottle self-standing. This eliminates the need for an auxiliary tool that assists in making the bottle self-standing, dispensing with an operation of installing and removing the auxiliary tool. Consequently, producing efficiency can be improved. Furthermore, the non-use of the auxiliary tool is sanitarily preferable for the aseptic filling, in which the contents at the ordinary temperature are filled in the sterile state. This also eliminates the need for the sterilization treatment for the auxiliary tool or the like, enabling prevention of a possible decrease in efficiency.

The present invention is further characterized in that the bottom part of the bottle except for the inversion part is retained simultaneously with the gripping of the upper portion of the body part of the filled bottle with the cap fitted thereon in the sealing step as well as the shoulder part of the filled bottle, which is continuous with the opening.

Thus, in performing the bottom part recessing step, the bottle is fixed at both the top and bottom thereof corresponding to the shoulder part and the bottom part, respectively. Thus, when the inversion part is pressed, the bottom part can be accurately positioned. As a result, the inversion part can be reliably inverted and recessed inwardly into the bottle.

Furthermore, to accomplish the above-described object, an aspect of a device according to the present invention comprises content filling means for filling liquid contents into an interior of the empty bottle with the inversion part projecting outwardly from the body part and with the contents not filled therein yet, and sealing means for fitting the cap onto the opening of the filled bottle with the liquid contents filled therein by the content filling means to seal the bottle. The content filling means may fill the contents heated to a predetermined temperature into the empty bottle (what is called hot filling) or fill the contents at the ordinary temperature into the empty bottle (what is called aseptic filling). The device further comprises auxiliary tool installing means for installing a cylindrical auxiliary tool on an outer periphery of the bottom part of the filled bottle with the cap fitted thereon by the sealing means, the auxiliary tool being shaped so as to be capable of being mounted on and removed to and from the bottom part of the bottle, a lower portion of the bottom part corresponding to the inversion part being open, bottom part recessing means for supporting, via the auxiliary tool, the bottom part of the filled bottle with the auxiliary tool installed on the bottom part by the auxiliary tool installing means, and pressing the inversion part up so as to invert and recess the inversion part inwardly into the bottle, and auxiliary tool separating means for separating the auxiliary tool from the filled bottle with the inversion part recessed inwardly into the body part by the bottom part recessing means.

The device according to the present invention is characterized in that the auxiliary tool installing means installs the auxiliary tool on the outer periphery of the bottom part of the filled bottle with the cap fitted thereon by the sealing means. Thus, the auxiliary tool is not installed on the bottle during a filling operation and a sealing operation performed by the content filling means and the sealing means, respectively. Consequently, the filling and sealing operations can be acceptably sanitarily performed.

Moreover, since the auxiliary installing means installs the auxiliary tool on the bottle, for example, the bottle can be transported in a self-standing state on a conveyor. Furthermore, after the auxiliary tool installing means installs the auxiliary tool on the bottle, the bottom part recessing means inverts and recesses the inversion part inwardly into the bottle. Thus, the auxiliary tool installed on the bottom part of the bottle prevents the bottom part of the bottle from being subjected to inadvertent deformation or the like. Therefore, a high-quality content filling bottle can be produced.

Furthermore, to accomplish the above-described object, another aspect of a device according to the present invention comprises content filling means for filling liquid contents into an interior of the empty bottle with the inversion part projecting outwardly from the body part and with the contents not filled therein yet, and sealing means for fitting the cap onto the opening of the filled bottle with the liquid contents filled therein by the content filling means to seal the bottle. The content filling means may fill the contents heated to a predetermined temperature into the empty bottle (what is called hot filling). However, in particular, the content filling means is suitably used when the contents at the ordinary temperature are filled into the empty bottle (what is called aseptic filling). The device further comprises bottle retaining means for gripping an upper portion of the body part of the filled bottle with the cap fitted thereon by the sealing means and a shoulder part of the filled bottle, which is continuous with the opening, to retain the filled bottle so that the bottle is inhibited from moving in a vertical direction, and bottom part recessing means for pressing up the inversion part of the bottom part of the filled bottle retained by the bottle retaining means, so as to invert and recess the inversion part inwardly into the bottle.

The device according to the present invention is characterized by the provision of the bottle retaining means. Thus, when the bottom part recessing means presses the inversion part up to invert and recess the inversion part inwardly into the bottle, the bottle retaining means reliably retains the bottle so as to inhibit the bottle from moving in the vertical direction. This eliminates the need for an auxiliary tool and allows the inversion part to easily perform the inverting and recessing operation. Consequently, during the operations from the filling of the contents through the inverting and recessing of the inversion part, no auxiliary tool needs to be installed on the bottle. The filling and sealing operations can thus be acceptably sanitarily performed. This further eliminates the need for a mechanism that installs and removes the auxiliary tool on and from the bottle. The device configuration can thus be simplified to enable a reduction in installation space and in producing costs.

The device is further characterized in that the bottle retaining means comprises body part gripping means for gripping the upper portion of the body part and the shoulder part, and bottom part supporting means for supporting the bottom part of the filled bottle, the bottom part supporting means being provided below the body part gripping means, and in that the bottom part supporting means comprises a supporting concave part corresponding to the bottom part of the bottle and an opening part opening the lower portion of the bottom part corresponding to the inversion part.

Thus, when the bottom part recessing means inverts and recesses the inversion part inwardly into the bottle, the body part gripping means and bottom part supporting means sandwichingly hold the shoulder part and the bottom part from above and from below. Consequently, when the inversion part is pressed, the bottom part can be accurately positioned. The inversion part can thus be reliably inverted and recessed inwardly into the bottle. Moreover, since the bottom part supporting means comprises a supporting concave part corresponding to the bottom part of the bottle and an opening part which is open in a lower bottom portion thereof corresponding to the inversion part, the bottle can be reliably supported even with the inversion part projecting downwardly from the bottom part of the bottle. Furthermore, since the device further comprises the supporting concave part corresponding to the bottom part of the bottle, the bottom part of the bottle is peripherally pressed to allow the bottom part recessing step to be carried out with inadvertent deformation of the bottom part reliably prevented.

BEST MODE FOR CARRYING OUT THE INVENTION

Figure 1:
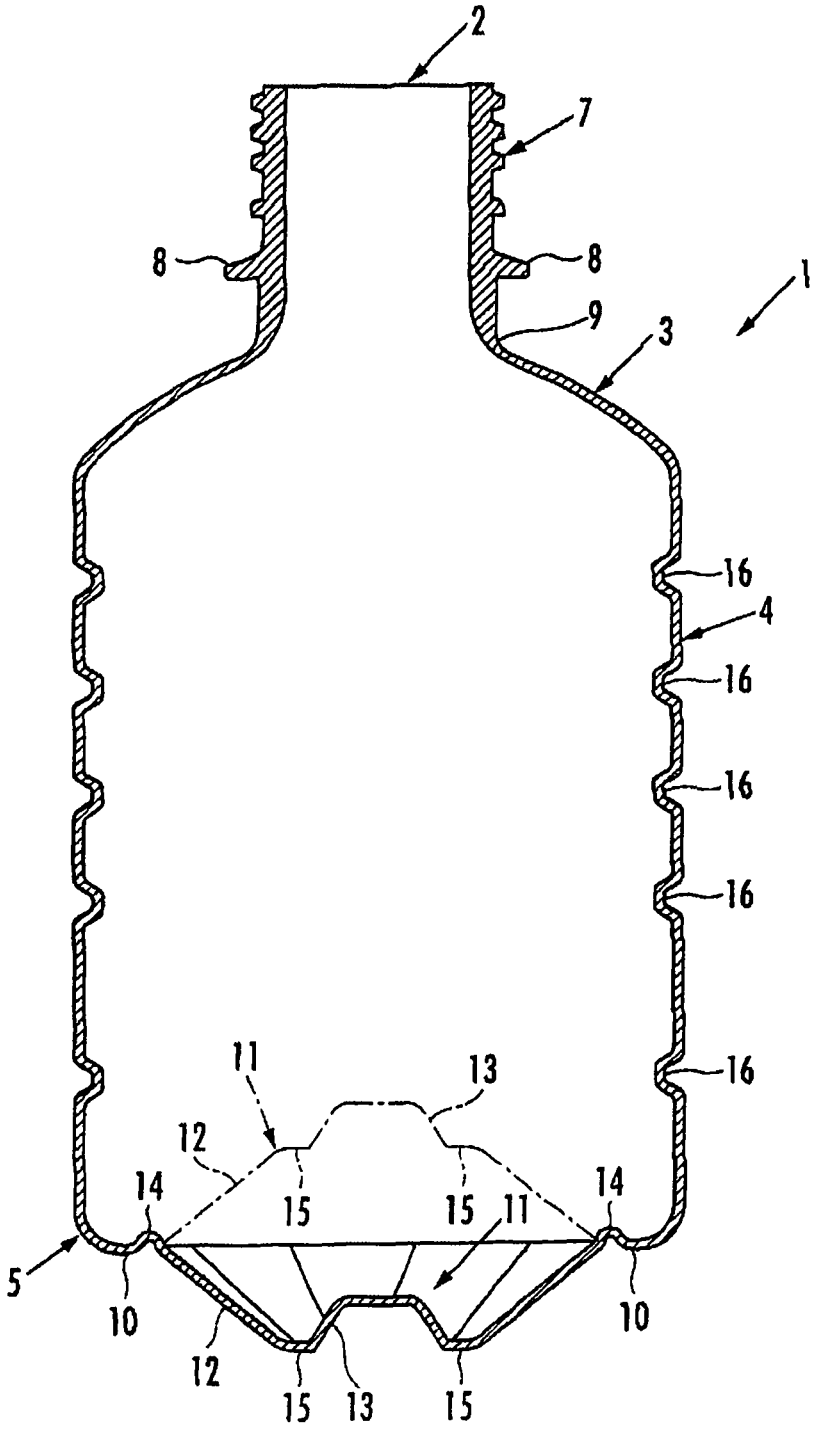
FIG. 1 is a sectional explanatory view of a synthetic resin bottle adopted in the present embodiment.

Embodiments of the present invention adopt a bottle 1 configured as shown in FIG. 1. The bottle 1 is made by blow forming a polyethylene terephthalate (PET) material. As shown in FIG. 1, the bottle 1 is made up of an opening 2, which opens upwardly, a hollow body part 4, which is continuous with a lower end of the opening 2 through an expanded diameter shoulder part 3, and a bottom part 5, which closes a lower end of the body part 4.

A threaded portion 7, to which a cap 6 (see FIG. 10) is threadably attached, is formed on the opening 2. A flange 8, which expands outwardly around the outer periphery of the threaded portion 7, is formed in a lower part of the threaded portion 7. A neck part 9 is formed between the flange 8 and the shoulder part 3.

A ring-shaped ground portion 10 is formed on an outer peripheral side of the bottom part 5. An inversion part 11, which projects outwardly (downwardly) along an axis of the body part 4, is formed inside of the ground portion 10. The inversion part 11 comprises an inclined portion 12, which can be inverted inwardly and outwardly of the body part 4 between a convex shape and a concave shape which are symmetrical, and an inward projecting portion 13 formed in an area (a central portion of the bottom part 5) surrounded by the inclined portion 12 and formed so as to project inwardly of the body part 4. A first hinge section 14 is disposed in an annular shape at an outer peripheral edge of the inclined portion 12. A second hinge section 15 is disposed in an annular shape at an inner peripheral edge (i.e., at the border between the inclined portion 12 and the inward projecting portion 13) of the inclined portion 12. The inclined portion 12 is inverted between the convex and concave shapes by bending of the first hinge section 14 and the second hinge section 15. On the other hand, the inward projecting portion 13 is not inverted but is only moved up and down in conjunction with inversion of the inclined portion 12. The shape of the inward projecting portion 13 is thus retained. Furthermore, in order to preserve strength, a plurality of beads 16 are formed on the body part 4. Moreover, although not shown in the drawings, a reduced pressure absorbing panel may be formed on the body part 4.

The inversion part 11 of the bottle 1 projects outwardly (downwardly) from the body part 4 at least before the bottle 1 is injected into a filler. Such a bottle 1 is obtained by blow forming the material such that the inversion part 11 projects outwardly in a mold (not shown in the drawings). The bottles 1 formed with the inversion part 11 thus projecting outwardly are, for example, carried into a filler in line. This eliminates an operation process carried out for a bottle into which the inversion part 11 is recessed inwardly, to project the inversion part 11 outwardly before injecting the bottle 1 into the filler. The bottle 1 is thus advantageous in terms of efficiency and costs.

First, a first embodiment of the present invention will be described.

Figure 2:
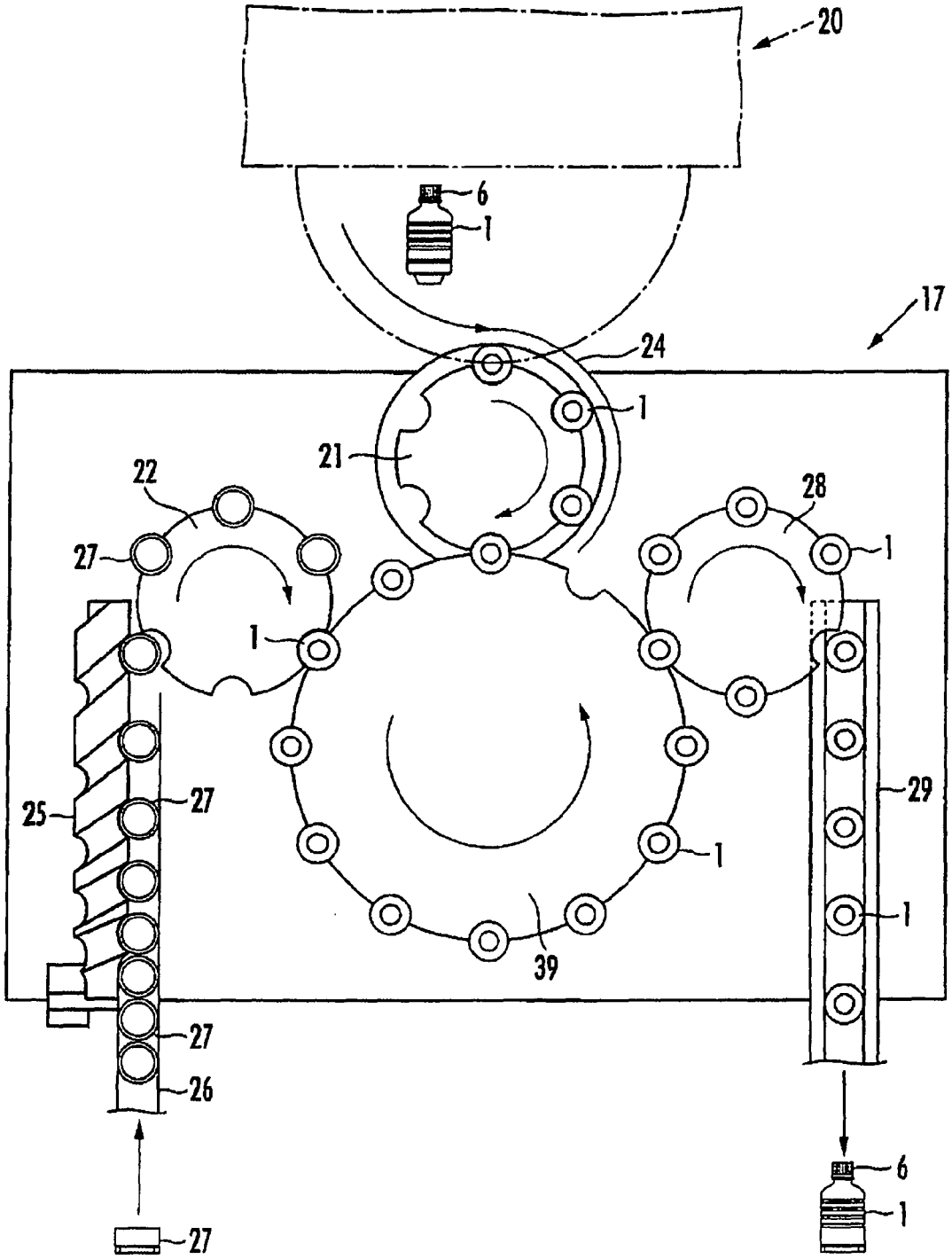
FIG. 2 is a plan view showing in outline the configuration of auxiliary tool installing means of a device according to a first embodiment of the present invention.
Figure 3:
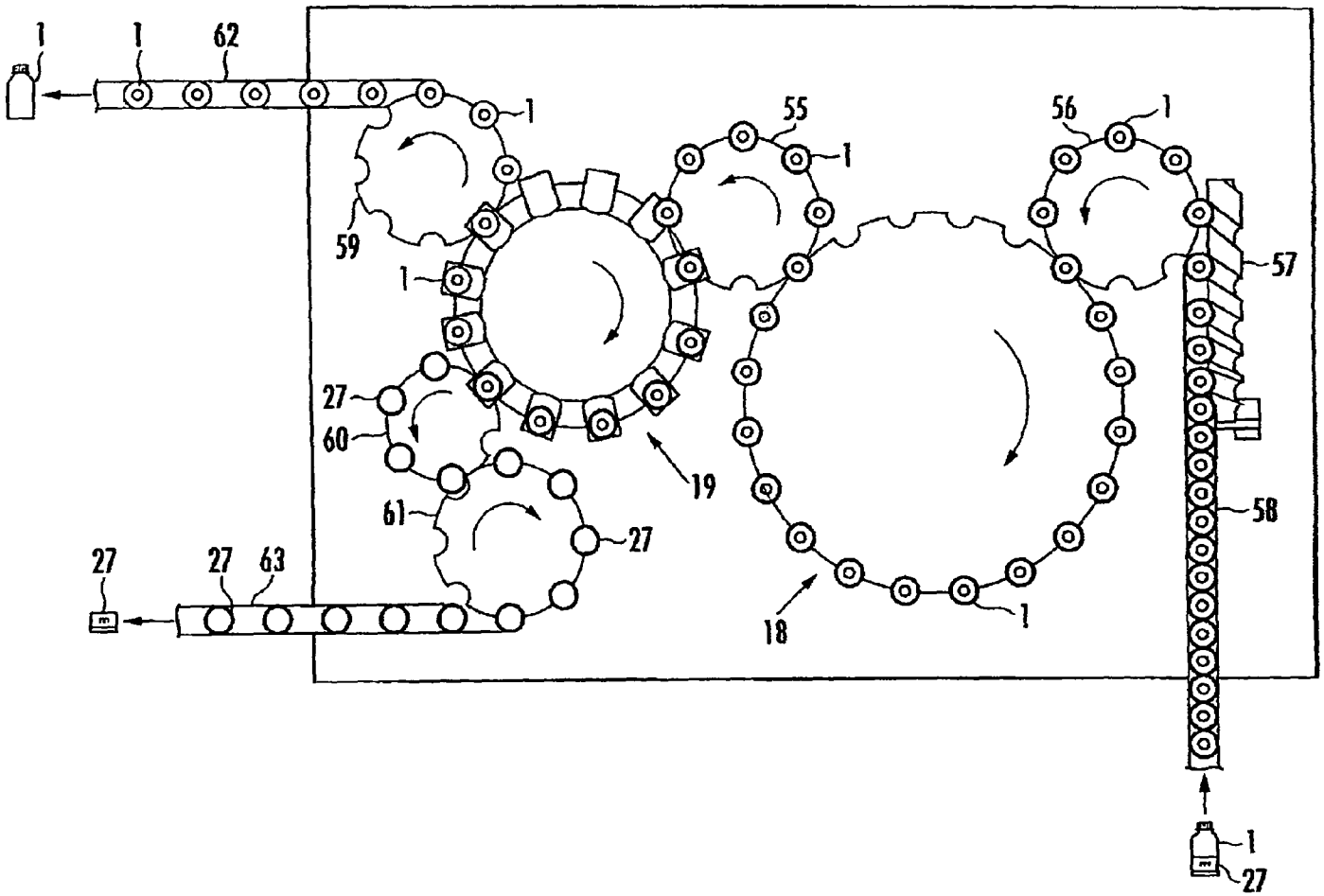
FIG. 3 is a plan view showing in outline the configuration of bottom part recessing means and auxiliary tool separating means of the device according to the first embodiment of the present invention.

A device according to the first embodiment produces a content filling bottle with contents such as a drink filled therein. A part of the device comprises auxiliary tool installing means 17, shown in FIG. 2, and bottom part recessing means 18 and auxiliary tool separating means 19, which are shown in FIG. 3.

Although not shown in the drawings, the filler and a capper 20 (shown in FIG. 2 by an alternate long and short dash line) are provided upstream of the auxiliary tool installing means 17; the filler is content filling means for filling the contents into the bottle 1 (see FIG. 1), the content filling means being configured in a well-known manner, and the capper 20 is sealing means for sealing the bottle 1 with a cap 6, the sealing means being configured in a well-known manner.

As is well-known, the filler performs either hot filling in which heated liquid contents in a high temperature state are filled or aseptic filling in which liquid contents at the ordinary temperature after sterilization are filled. For the hot filling, a rinser, which washes the interior of the bottle 1, is provided upstream of the filler. For the aseptic filling, a sterilization treatment device for the bottle 1 is provided upstream of the filler. Furthermore, for the aseptic filling, an upstream side including at least the capper 20 is set in a sterile environment.

Now, an essential part of the device according to the first embodiment will be described. As shown in FIG. 2, a filled bottle injection turret 21 and an auxiliary tool injection turret 22 are provided upstream of the auxiliary tool installing means 17; the bottle 1 (hereinafter referred to as the filled bottle) discharged from the capper 20, with the contents filled therein and with the opening 2 sealed with the cap 6, is injected into the filled bottle injection turret 21.

The example shown in FIG. 2 is suitable for the hot filling; the capper 20 and the filled bottle injection turret 21 of the auxiliary tool installing means 17 are installed adjacent to each other. However, for the aseptic filling, the effect of outer air on a discharge side of the capper 20 in the sterile environment is taken into account. That is, for the aseptic filling, although not shown in the drawings, the capper 20 is in the sterile atmosphere as described above so that devices constituting the capper 20 are kept sterile. On the discharge side of the capper 20, a position where the sterile atmosphere contacts the outer air is located as far from the devices constituting the capper 20 as possible to inhibit the outer air from mixing into the sterile atmosphere. By way of a specific example, a plurality of discharge turrets are disposed on the discharge side of the capper 20 toward a downstream side to provide a relatively long discharge conduit for the capper 20. Thus, the sterile atmosphere extends down to a terminal end of the discharge conduit, along which the plurality of discharge turrets are provided. Thus, even when the sterile atmosphere contacts the outer air on the terminal end side of the discharge conduit, the sterile atmosphere on a start point side of discharge conduit is prevented from being affected by the outer air. The devices constituting the capper 20 are thus kept sterile. On the other hand, for the hot filling, the capper 20 is prevented from being affected by the mixture of the outer air. Thus, as shown in FIG. 2, the capper 20 and the filled bottle injection turret 21 of the auxiliary tool installing means 17 are provided adjacent to each other.

Figure 13:
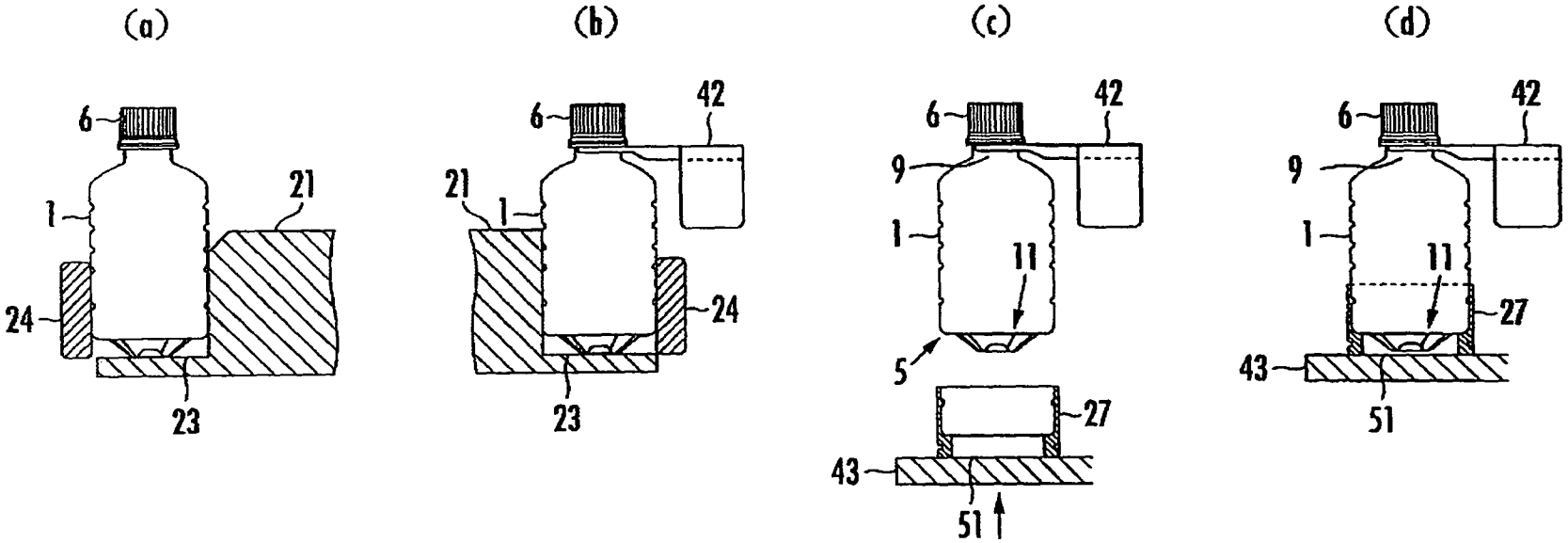
FIG. 13 is an explanatory view typically showing an auxiliary tool installing step performed by the device according to the first embodiment of the present invention.

As partly shown in FIG. 13(*a*), the filled bottle injection turret 21 comprises a retaining section 23, which retains a lower half of the filled bottle 1, and a regulating plate 24, which prevents the filled bottle 1 from slipping out in the retaining section 23. The filled bottle injection turret 21 injects the filled bottle 1 discharged from the capper 20, into the auxiliary tool installing means 17. As shown in FIG. 2, the auxiliary tool injection turret 22 is connected to a terminal end of the auxiliary tool injection conduit 26, which comprises a screw conveyor 25, to inject an auxiliary tool 27 into the auxiliary tool installing means 17. A discharge turret 28 and a discharge conveyor 29 are provided downstream of the auxiliary tool installing means 17 to discharge the filled bottle 1 with the auxiliary tool 27 installed thereon. The discharge conveyor 29 transports the filled bottle 1 with the auxiliary tool 27 installed thereon to the bottom part recessing means 18, shown in FIG. 3.

Figure 4:
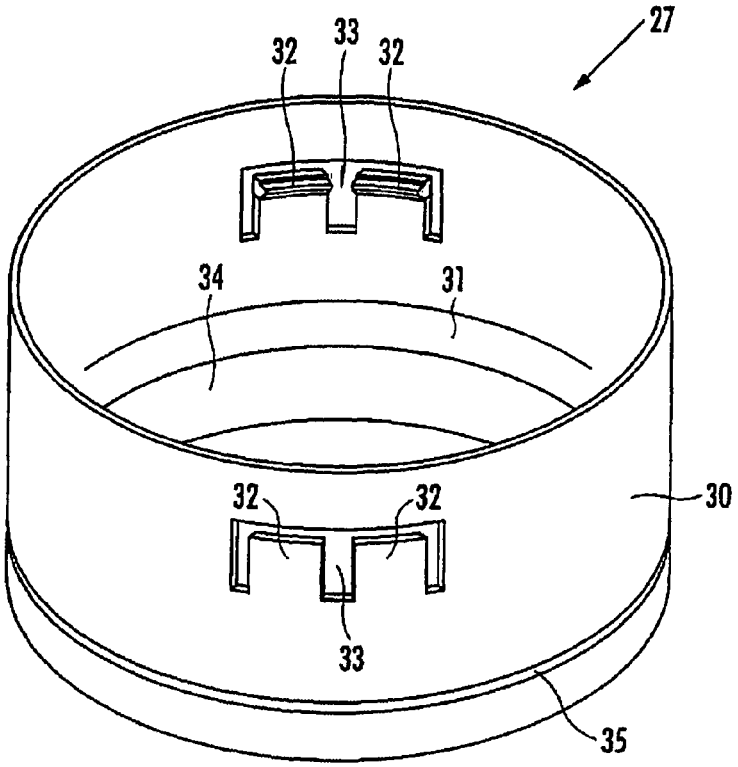
FIG. 4 is a perspective view of an auxiliary tool.
Figure 5:
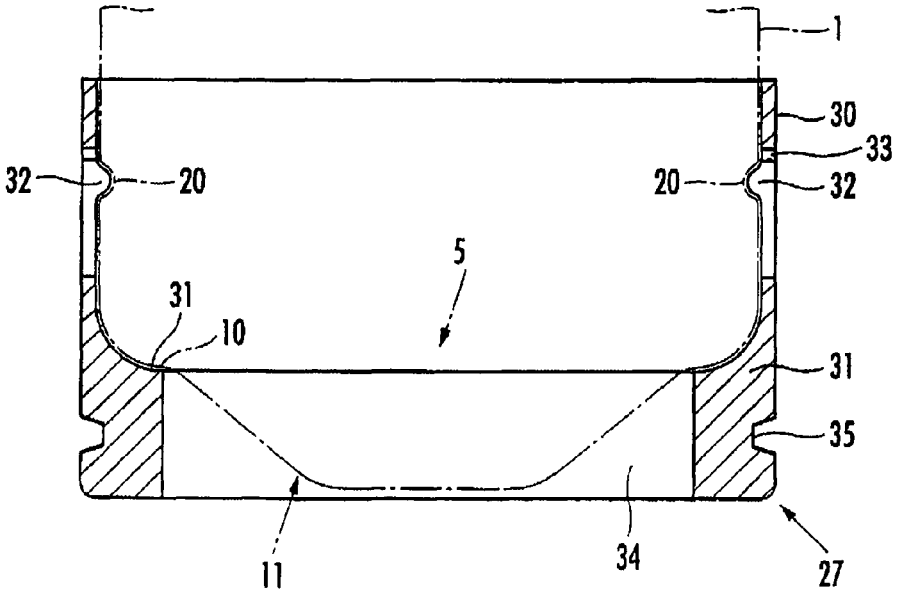
FIG. 5 is an explanatory vertical cross sectional view of the auxiliary tool.

The auxiliary tool 27 is cylindrically formed of a comparatively hardened synthetic resin material, and is installable onto the bottle 1 so as to extend from a lower end of the body part 4 of the bottle 1 to cover the bottom part 5 of the bottle 1. As shown in FIGS. 4 and 5, the auxiliary tool 27 is formed by a peripheral wall 30 and a bottom part supporting section 31. Bead engaging pawls 32 are provided on the peripheral wall 30 of the auxiliary tool 27; the bead engaging pawls 32 project inwardly and are engageable with and disengageable from the lowermost positioned beads 16 formed in the body part 4. The bead engaging pawls 32 engage elastically with the beads 16 of the bottle 1 through peripheral cuts 33. An opening part 34 is formed in the bottom part supporting section 31 of the auxiliary tool 27 at a position corresponding to the inversion part 11 of the bottle 1. An annular engagement groove 35 is formed on an outer peripheral surface of the auxiliary tool 27. The auxiliary tool 27 according to the first embodiment has the cylindrical shape corresponding to the shape of the bottle 1. However, if for example, the bottle is shaped like a polygonal prism, the auxiliary tool 27 is correspondingly shaped like a polygonal tube.

Figure 6:
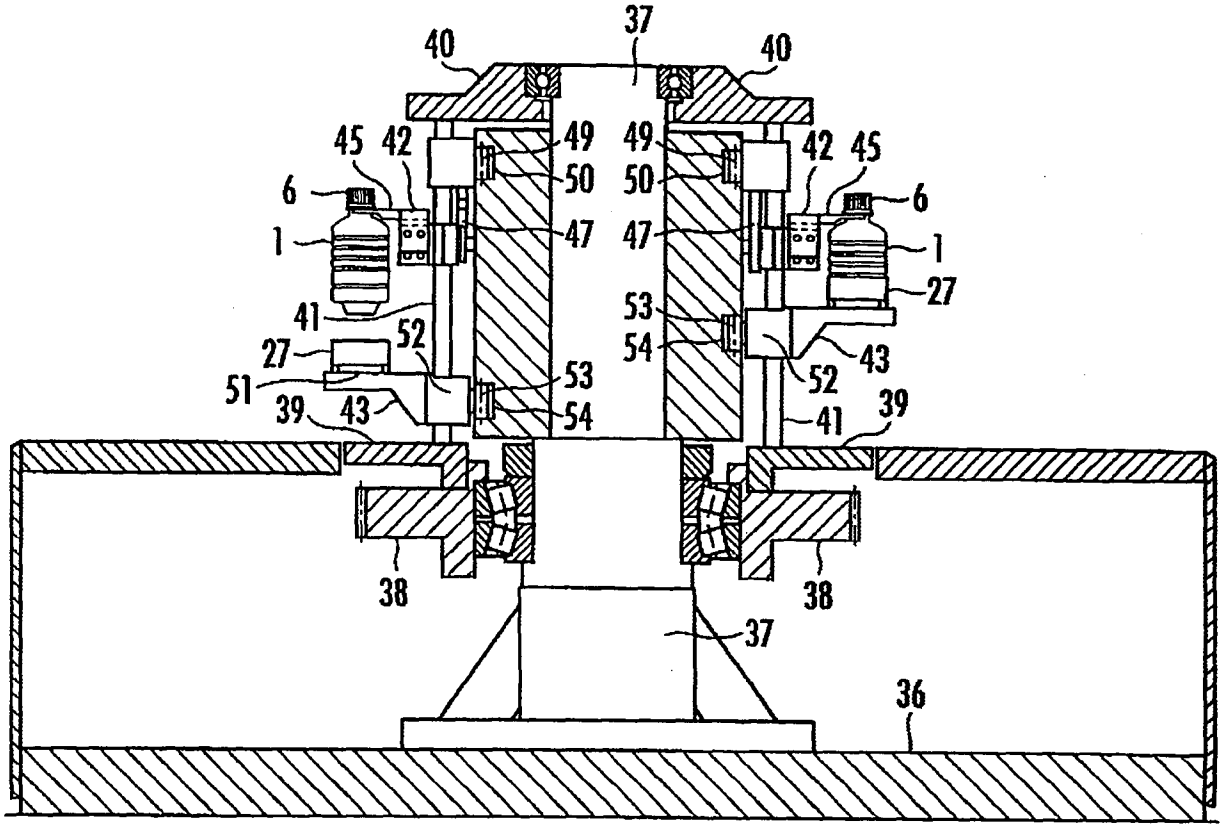
FIG. 6 is an explanatory cross sectional view of auxiliary tool installing means.

As shown in FIG. 6, the auxiliary tool installing means 17 comprises a support pillar 37, which is disposed upright on a base 36, a drive gear 38, which is supported rotatably on the support pillar 37, and a turntable 39, which rotates integrally with the gear 38. A top panel 40 is supported rotatably on an upper end of the support pillar 37. The top panel 40 and the turntable 39 are connected together integrally by a plurality of vertically extending guide rods 41. The gear 38 is connected to rotary driving means such as a motor (not shown in the drawings).

The auxiliary tool installing means 17 comprises a filled bottle chuck 42, which is fixed to and supported by the guide rods 41, and an auxiliary tool support table 43, which is supported below the filled bottle chuck 42 by the guide rods 41 so as to be capable of being raised and lowered.

Figure 7:
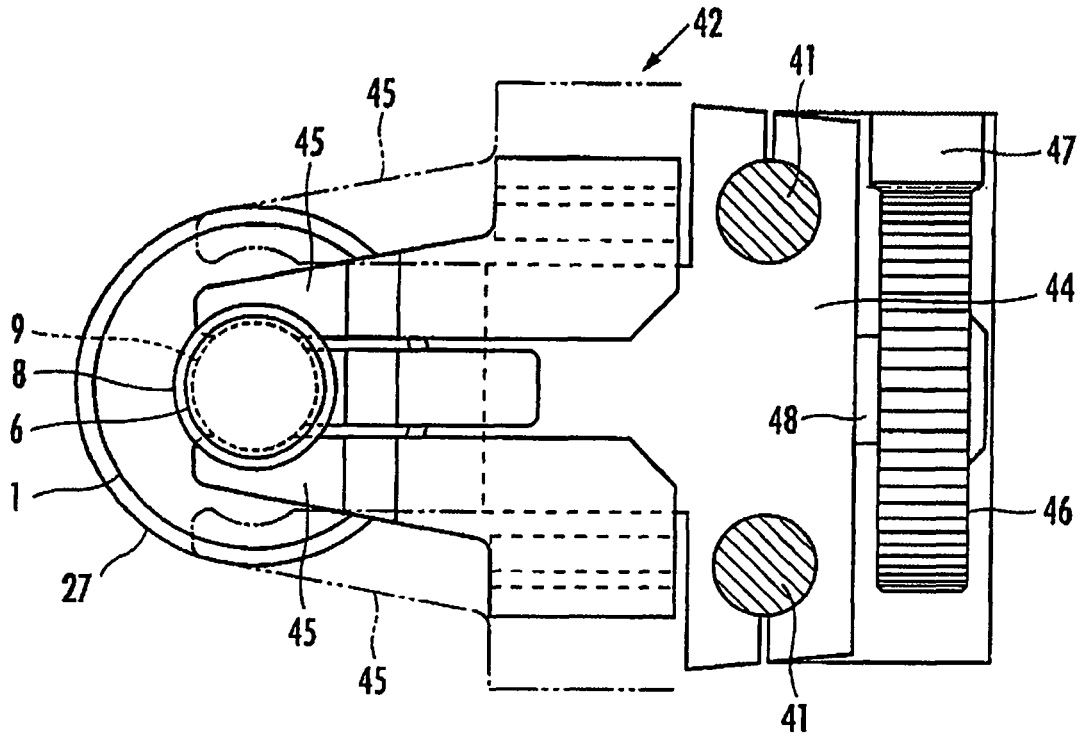
FIG. 7 is an explanatory plan view of a filled bottle chuck.
Figure 8:
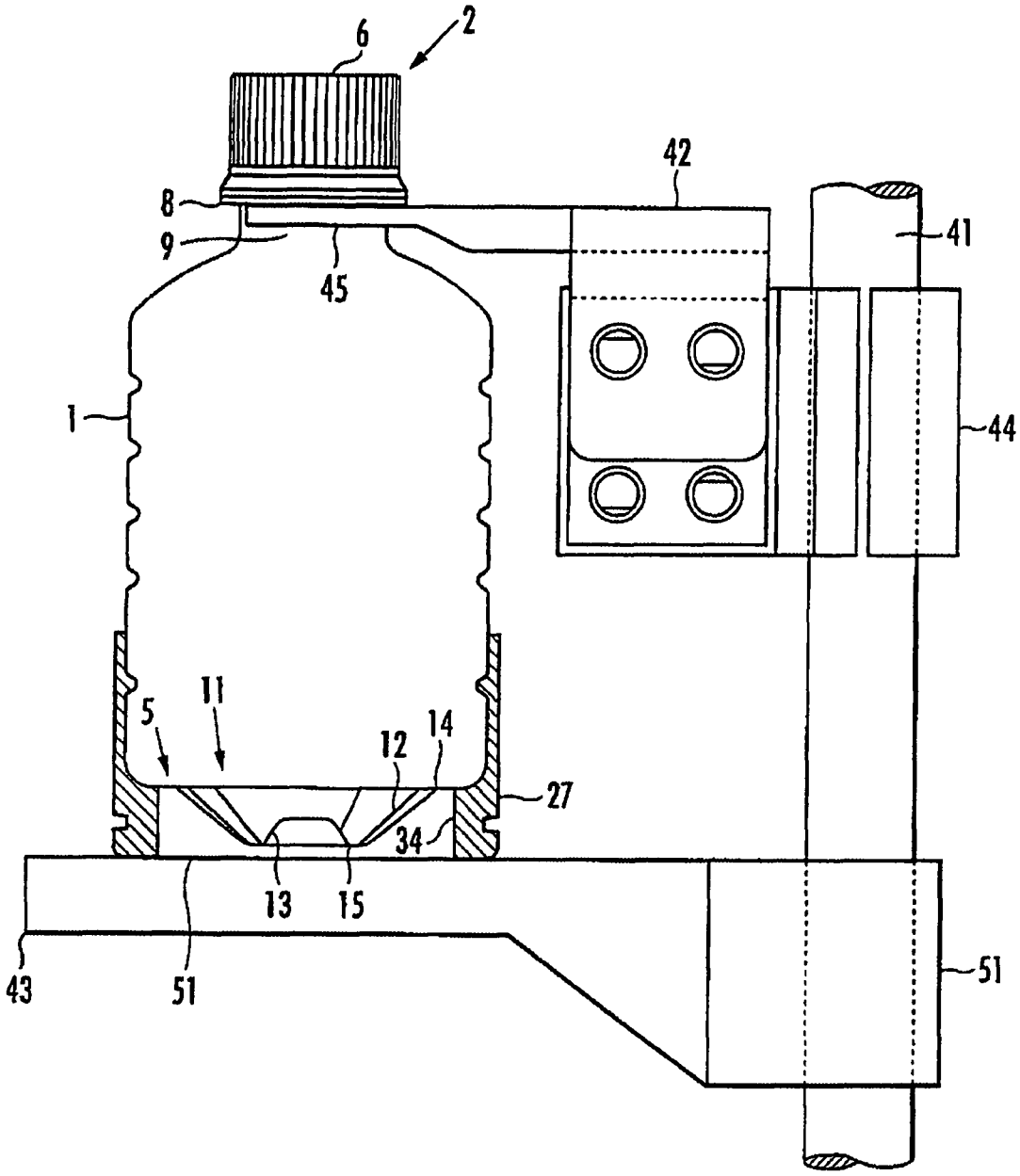
FIG. 8 is an explanatory view showing a retained state of a filled bottle.

As shown in FIG. 7, the filled bottle chuck 42 comprises a base block 44, which is fixedly supported on the guide rods 41, and a pair of claw members 45, which are openably and closably supported on the base block 44. A pinion gear 46 is disposed outside the base block 44 of the filled bottle chuck 42. As shown in FIG. 6, the pinion gear 46 meshes with a rack 47, which is disposed so as to be capable of being raised and lowered along the guide rod 41. As shown in FIG. 7, the pinion gear 46 drives an opening and closing mechanism (not shown in the drawings), which is contained in the base block 44 via a rotating shaft 48. The pinion gear 46 rotates in response to rising and lowering of the rack 47, thus opening and closing the claw members 45. As shown in FIG. 6, the rack 47 comprises a cam follower 49, which is guided by a cam rail 50 disposed on an outer periphery of the support pillar 37, to raise and lower the rack 47. As shown in FIG. 8, the claw members 45 of the filled bottle chuck 42 externally grip the neck part 9 of the filled bottle 1.

As shown in FIGS. 6 and 8, the auxiliary tool support table 43 comprises an auxiliary tool loading section 51, on which the auxiliary tool 27 injected by the auxiliary tool injection turret 22 (see FIG. 2) is loaded, and a raising and lowering block 52, which is supported on the guide rod 41 so as to be capable of being raised and lowered along the guide rod 41. As shown in FIG. 6, the raising and lowering block 52 comprises a cam follower 53, which is guided by a cam rail 54 disposed on an outer periphery of the support pillar 36, to raise and lower the auxiliary tool loading section 51. The auxiliary tool support table 43 rises toward the bottom part 5 of the filled bottle 1 retained by the filled bottle chuck 42, to install the auxiliary tool 27 loaded on the auxiliary tool loading section 51, on the filled bottle 1.

Now, the bottom part recessing means 18 and the auxiliary tool separating means 19 will be described. As shown in FIG. 3, the bottom part recessing means 18 and the auxiliary tool separating means 19 are disposed adjacent to each other. The auxiliary tool separating means 19 is connected to a downstream side of the bottom part recessing means 18 through a filled bottle transfer turret 55. A filled bottle injection turret 56 is disposed upstream of the bottom part recessing means 18. The filled bottle injection turret 56 is connected to a terminal end of a filled bottle injection conduit 58, which comprises a screw conveyor 57, to inject, into the bottom part recessing means 18, the filled bottle 1 discharged from the auxiliary tool installing means 17 and having the auxiliary tool 27 installed thereon. A filled bottle discharge turret 59, a first auxiliary tool discharge turret 60, and a second auxiliary tool discharge turret 61 are disposed downstream of the auxiliary tool separating means 19. A start point of a filled bottle discharge conveyor 62 is connected to the filled bottle discharge turret 59. A start point of an auxiliary tool discharge conveyor 63 is connected to the second auxiliary tool discharge turret 61.

Figure 9:
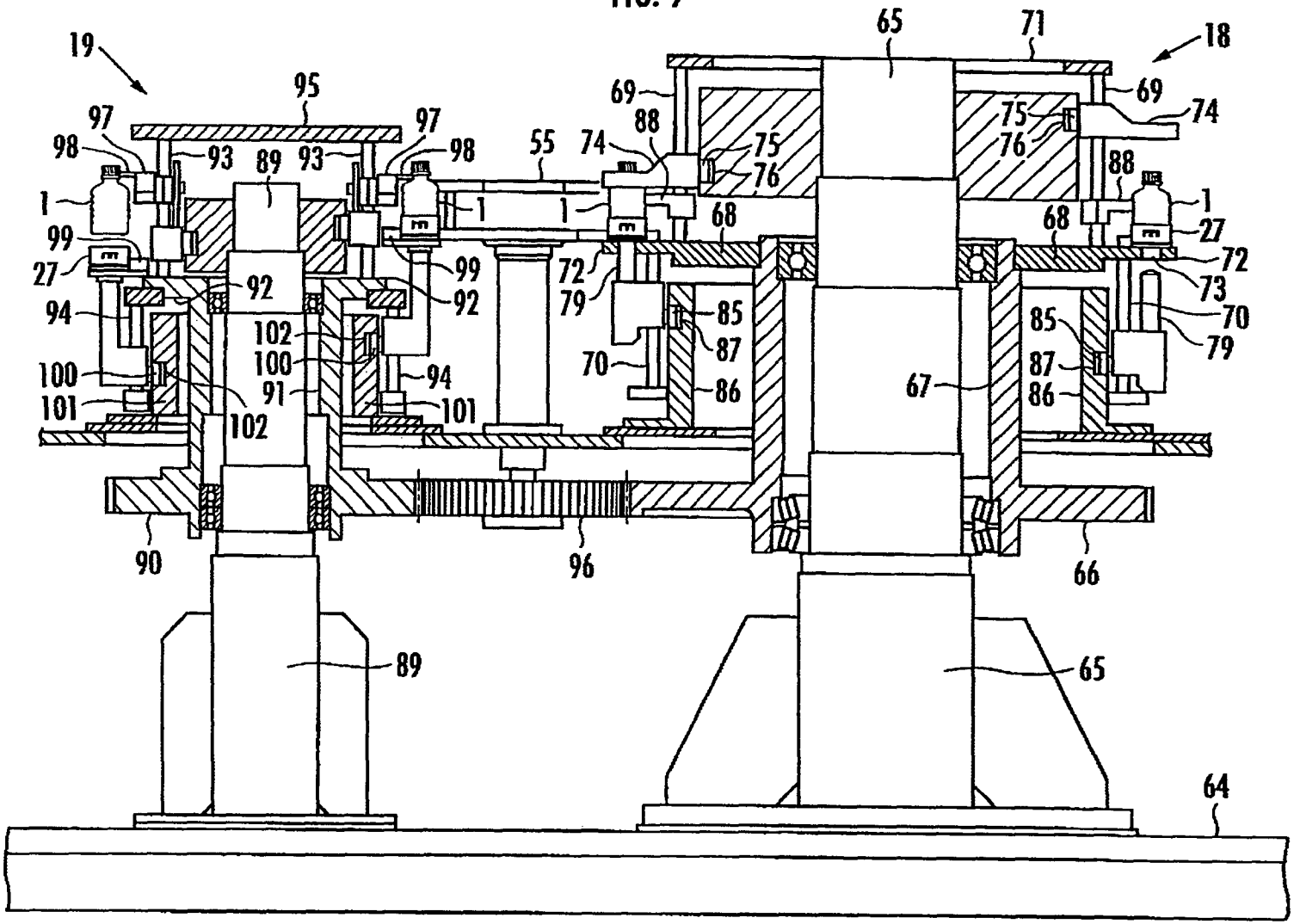
FIG. 9 is an explanatory cross sectional view showing bottom part recessing means and auxiliary tool separating means.

As shown in FIG. 9, the bottom part recessing means 18 comprises a support pillar 65 disposed upright on a base 64, a drive gear 66, which is rotatably supported on the support pillar 65, and an outer tubular support body 67, which rotates integrally with the gear 66. A filled bottle support table 68 is disposed integrally with the outer tubular support body 67. A plurality of first guide rods 69 are disposed on the filled bottle support table 68 so as to extend upwardly therefrom. A plurality of second guide rods 70 are disposed on the filled bottle support table 68 so as to extend downwardly therefrom. A top plate 71 is supported integrally on upper ends of the first guide rods 69. The gear 66 is connected to rotary driving means (not shown in the drawings) such as a motor.

The filled bottle support table 68 comprises a plurality of filled bottle loading sections 72, in each of which an opening part 73 corresponding to the inversion part 11 of the filled bottle 1 is formed so as to penetrate the loading section 72 in the vertical direction.

Figure 10:
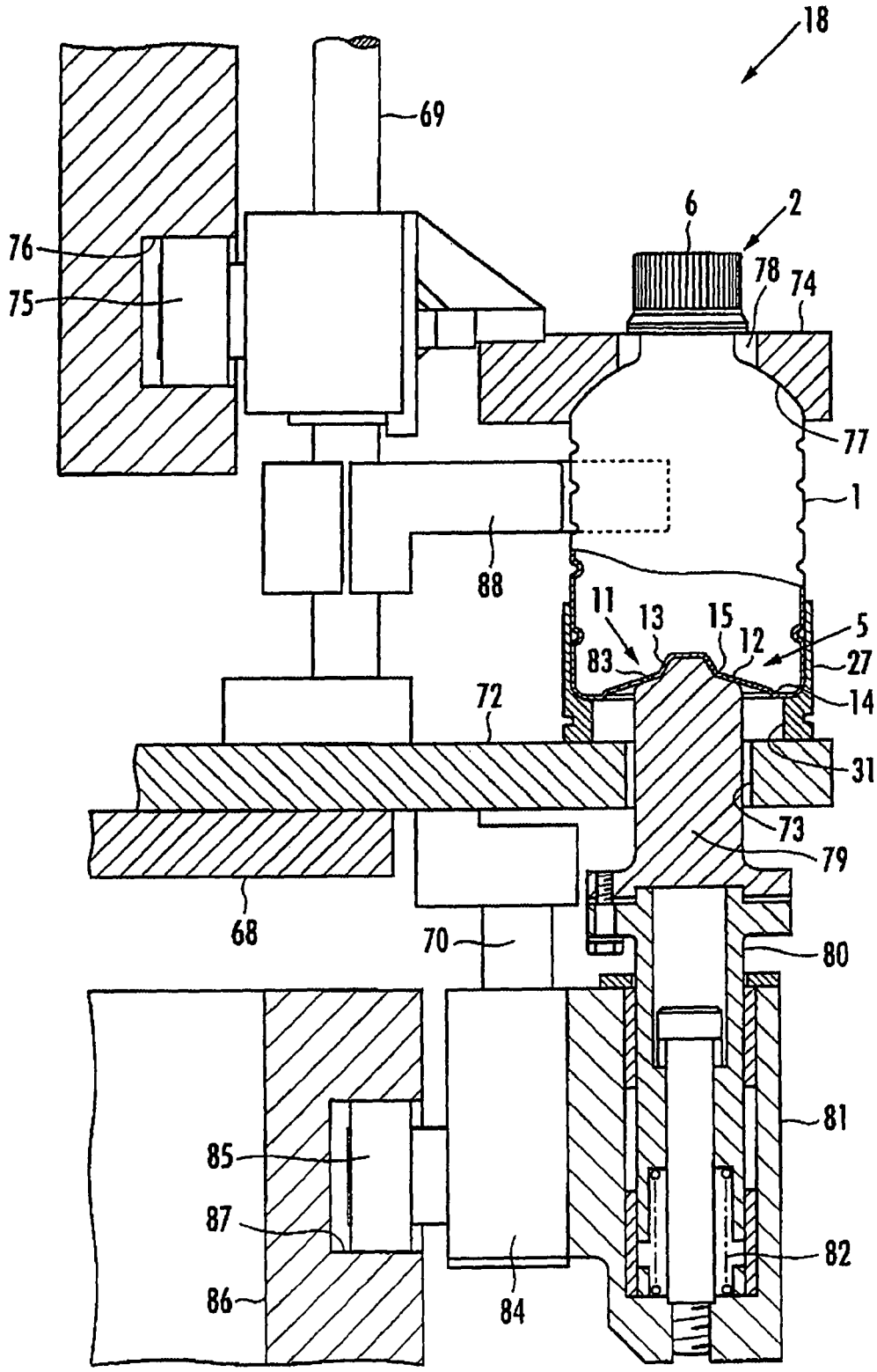
FIG. 10 is an explanatory view showing a retained state of the filled bottle in the bottom part recessing means.
Figure 11:
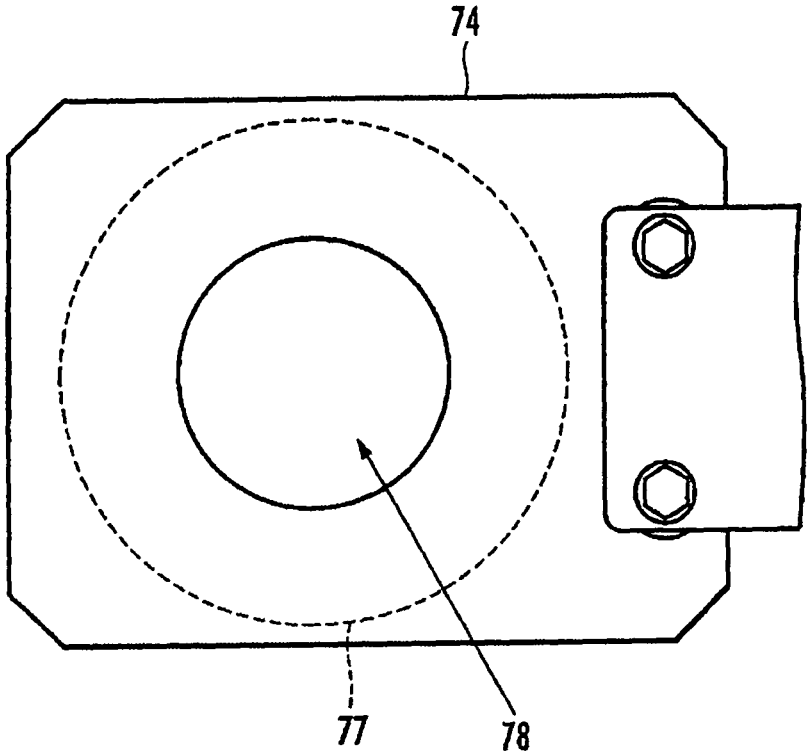
FIG. 11 is an explanatory plan view of a shoulder part presser.

A shoulder part presser 74 is supported on the first guide rod 69 so as to be capable of being raised and lowered along the first guide rod 69. The shoulder part presser 74 comprises a cam follower 75, which is guided by a cam rail 76, disposed on an outer periphery of the support pillar 65, to raise and lower the shoulder part presser 74. As shown in FIG. 10, the shoulder part presser 74 comprises a pressing concave part 77 with a shape corresponding to the shoulder part 3 of the filled bottle 1. As shown in a plan view in FIG. 11, the shoulder part presser 74 comprises an insertion hole 78, through which the opening 2 with the cap 6 fitted thereon is capable of being inserted.

As shown in FIG. 9, an activator punch 79 is supported on the second guide rod 70 so as to be capable of being raised and lowered along the second guide rod 70. As shown in FIG. 10, the activator punch 79 is connected to an upper end of a raising and lowering shaft 80, which is retained in a guide tube 81 so as to be capable of being raised and lowered through a shock absorbing spring 82. A pushup abutment section 83 with a shape corresponding to the inclined portion 12 and inward projecting portion 13 of the inversion part 11 is formed at a tip end of the activator punch 79. The guide tube 81 is connected to a slide block 84, which is slidably retained on the second guide rod 70. The slide block 84 comprises a cam follower 85, which is guided by a cam rail 87 in a tubular wall plate 86, to raise and lower the activator punch 79; the tubular wall plate 86 is fixed to the periphery of the support pillar 65 with a gap between the tubular wall plate 86 and the support pillar 65 as shown in FIG. 9. In the first embodiment, as shown in FIG. 10, the shape of the pushup abutment section 83 is shown to correspond to the inclined portion 12 and inward projecting portion 13 of the inversion part 11. However, for example, although not shown in the drawings, the pushup abutment section 83 may be shaped so as to abut peripherally against a part of the inclined portion 12.

The activator punch 79 is disposed below each of the filled bottle loading sections 72 of the filled bottle support table 68. When rotated around the support pillar 65, the activator punch 79 is guided by the cam rail 87 to rise through the opening part 73 of the filled bottle loading section 72. Thus, a tip end of the activator punch 79 pushes up the inversion part 11 projecting downwardly from the filled bottle 1. The inversion part 11 is recessed inwardly into the filled bottle 1. At this time, the shock absorbing spring 82, which is provided in the interior of the guide tube 81, prevents an excessive pushing force from the activator punch 79 from being exerted on the inversion part 11. The inversion part 11 is thus reliably prevented from being damaged. Furthermore, the pushup abutment section 83, which is provided at the tip end of the activator punch 79, enables the inversion part 11 to be reliably recessed inwardly into the filled bottle along the recessed shape thereof. The bottom part 5 can thus be reliably prevented from being inadvertently deformed, allowing the inversion part 11 to be smoothly recessed inwardly into the filled bottle. In FIGS. 9 and 10, reference numeral 88 indicates a holder that laterally supports the filled bottle 1.

As shown in FIG. 9, the auxiliary tool separating means 19 comprises a support pillar 89, which is disposed upright on the base 64, a drive gear 90, which is rotatably supported on the support pillar 89, and an outer tubular support body 91, which rotates integrally with the gear 90. A flange-shaped projecting portion 92 is provided on an outer periphery of an upper end of the outer tubular support body 91. A plurality of first guide rods 93 are disposed on the projecting portion 92 so as to extend upwardly therefrom. A plurality of second guide rods 94 are disposed on the projecting portion 92 so as to extend downwardly therefrom. A top plate 95 is supported integrally on upper ends of the first guide rods 93. The gear 90 is rotated via a drive gear 96 of the filled bottle transfer turret 55 in synchronism with the gear 66 of the bottom part recessing means 18, described above.

A filled bottle chuck 97 is fixedly supported on the first guide rod 93. The filled bottle chuck 97 comprises a pair of claw members 98 which open and close. The filled bottle chuck 97 has a configuration similar to that of the filled bottle chuck 42 of the auxiliary tool installing means 17, described above, and the detailed description of the filled bottle chuck 97 is thus omitted.

Figure 12:
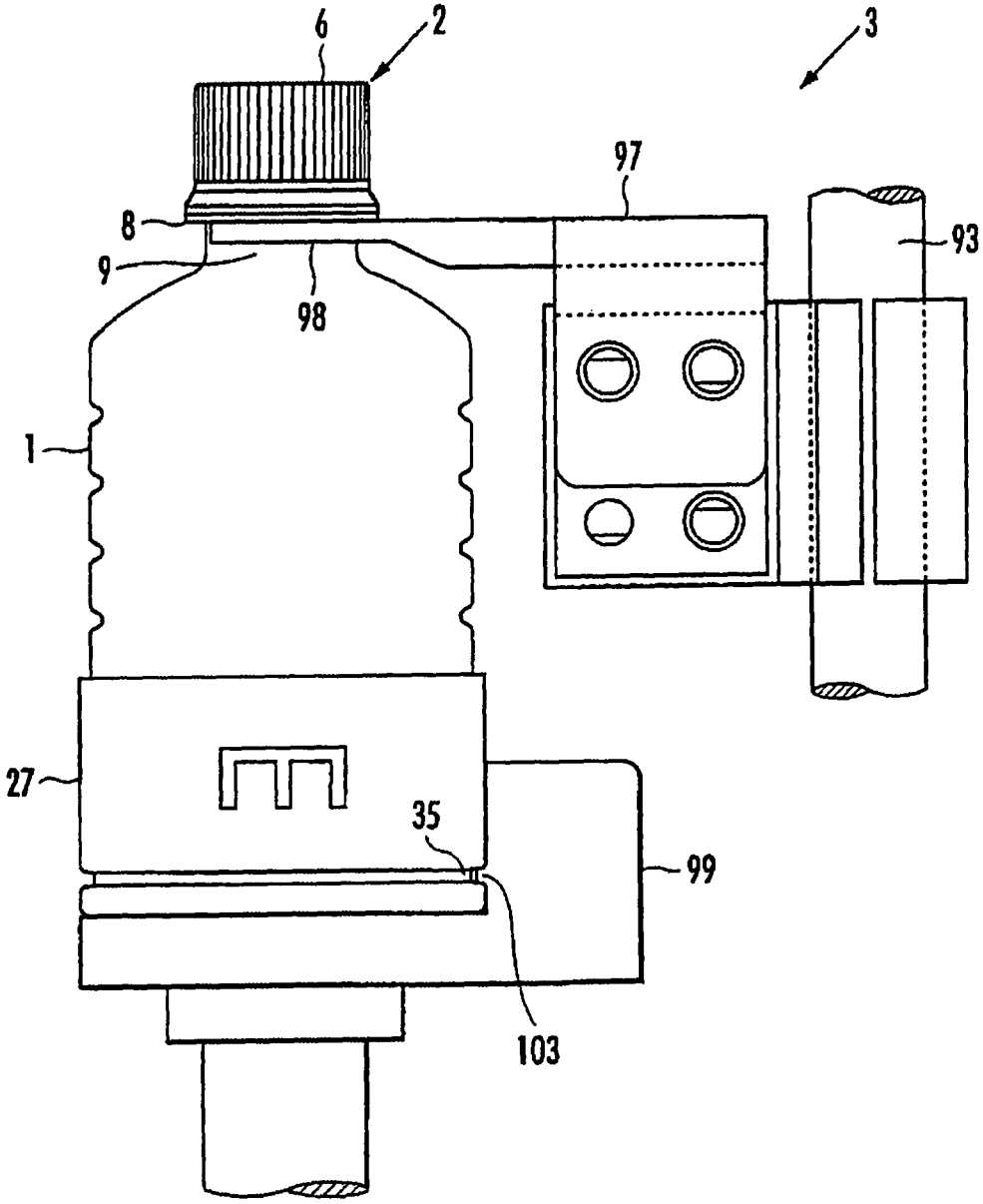
FIG. 12 is an explanatory view showing a retained state of the filled bottle in the auxiliary part separating means.

As shown in FIG. 9, an auxiliary tool connection member 99 is supported on the second guide rod 94 so as to be capable of being raised and lowered along the second guide rod 94. The auxiliary tool connection member 99 comprises a cam follower 100, which is guided by a cam rail 102 in a tubular wall plate 101, to raise and lower the auxiliary tool connection member 99; the tubular wall plate 101 is disposed around the periphery of the support pillar 89 with a gap between the tubular wall plate 101 and the support pillar 89. As shown in FIG. 12, the auxiliary tool connection member 99 comprises a projection 103, which engages with an engagement groove 35 formed in an outer peripheral surface of the auxiliary tool 27. The auxiliary tool connection member 99 rises toward the auxiliary tool 27 to engage the projection 103 with the engagement groove 35. The auxiliary tool connection member 99 then lowers with the engagement state maintained, to separate the auxiliary tool 27 from the filled bottle 1. As shown in FIG. 3, the filled bottle 1 and auxiliary tool 27 separated from each other are transferred to the filled bottle discharge turret 59 and the first auxiliary tool discharge turret 60, respectively. The filled bottle 1 and auxiliary tool 27 are then discharged.

The device configured as described above according to the first embodiment produces the content filling bottle as described below. That is, although not shown in the drawings, the filler fills liquid contents into the interior of the empty bottle 1 with the inversion part 11 inversely projecting downwardly as shown in FIG. 1 (content filling step). The capper 20 fits the cap 6 on the opening 2 of the filled bottle 1 with the liquid contents filled therein, to seal the filled bottle 1 (sealing step). The operations in the filler and the capper 20 are performed with the neck part 9 of the empty bottle 1 gripped and transported and without the need to make the empty bottle 1 self-standing. The filling and sealing operations can be performed without any problem even when the bottle is blow-formed such that the inversion part 11 inversely projects downwardly as shown in FIG. 1.

Then, the auxiliary tool installing means 17, shown in FIGS. 2 and 6, installs the auxiliary tool 27 on the bottom part 5 of the filled bottle 1 (auxiliary tool installing step). Subsequently, the bottom part recessing means 18, shown in FIGS. 3 and 9, presses up the inversion part 11 projecting downwardly from the filled bottle 1, to invert and recess the inversion part 11 inwardly into the bottle 1 as shown in FIG. 10 (bottom part recessing step). Then, the auxiliary tool separating means 19, shown in FIG. 12, separates the auxiliary tool 27 from the filled bottle 1 with the inversion part 11 inwardly recessed (auxiliary tool separating step).

Now, the operation of each part or section will be described in detail. First, the filled bottle 1 retained by the filled bottle injection turret 21 is injected into the auxiliary tool installing means 17 as shown in FIG. 13(*a*), and is gripped by the filled bottle chuck 42 of the auxiliary tool installing means 17 for delivery, as shown in FIG. 13(*b*). The filled bottle chuck 42 externally grips the neck part 9 of the filled bottle 1. After the delivery of the filled bottle 1 is completed, raising of the auxiliary tool support table 43 with the auxiliary tool 27 loaded thereon is started as shown in FIG. 13(*c*). With the auxiliary tool support table 43 raised, the auxiliary tool 27 is installed on the bottom part 5 of the filled bottle 1 retained by the filled bottle chuck 42, as shown in FIG. 13(*d*). Subsequently, the retention of the filled bottle 1 by the filled bottle chuck 42 is canceled. The filled bottle 1 is then delivered to the discharge turret 28, shown in FIG. 2, for discharge. The discharged filled bottle 1 is then injected into the bottom part recessing means 18, shown in FIG. 3.

Figure 14:
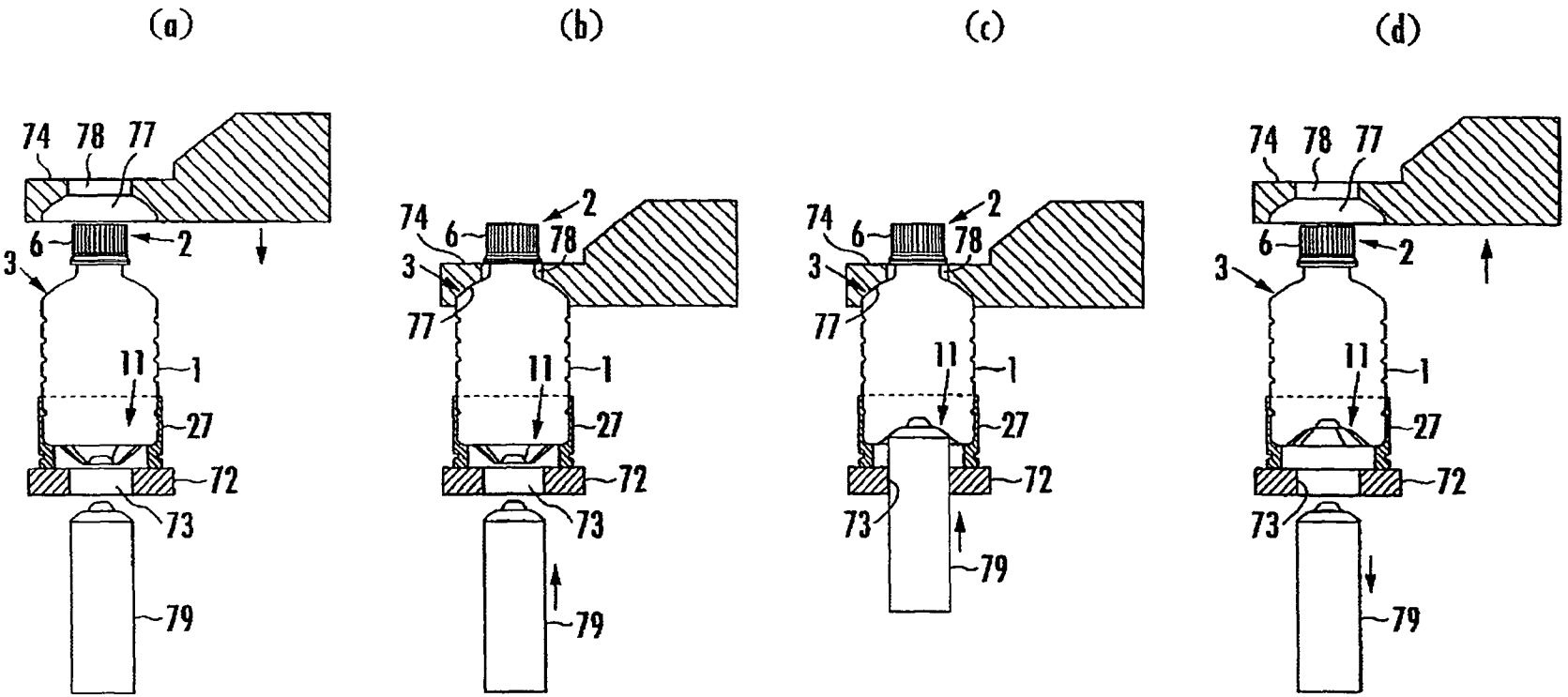
FIG. 14 is an explanatory view typically showing a bottom part recessing step performed by the device according to the first embodiment of the present invention.

In the bottom part recessing means 18, first, the filled bottle 1 is loaded on the filled bottle support table 68 as shown in FIG. 14(*a*). Then, as shown in FIG. 14(*b*), the shoulder part presser 74 lowers to press, from above, the shoulder part 3 of the filled bottle 1 loaded on the filled bottle support table 68. This positions the filled bottle 1 such that the bottle 1 is inhibited from moving upwardly. With the filled bottle 1 kept positioned as described above, as shown in FIG. 14(*c*), the activator punch 79 is raised to allow the tip end of the activator punch 79 to push up the projecting inversion part 11 of the filled bottle 1 so that the inversion part 11 is inwardly recessed. At this time, as shown in FIG. 10, the pushup abutment section 83 of the activator punch 79 inwardly recesses the inversion part 11 along the recessed shape thereof. Thus, the bottom part 5 can be reliably prevented from being inadvertently deformed, allowing the inversion part 11 to be inwardly recessed smoothly. Moreover, the filled bottle 1 is positioned by the shoulder part presser 74, and the auxiliary tool 27 sufficiently regulates the deformation of the bottom part 5 toward the outer periphery of the bottle. Consequently, the pushup abutment section 83 of the activator punch 79 abuts accurately against the inclined portion 12 and inward projecting portion 13 of the inversion part 11. Furthermore, the inversion part 11 can be reliably inwardly recessed without inadvertently deforming the bottom part 5. Subsequently, as shown in FIG. 14(*d*), the activator punch 79 is lowered below the filled bottle support table 68. The shoulder part presser 74 is raised to deliver the filled bottle 1 to the filled bottle transfer turret 55 as shown in FIG. 3. The filled bottle transfer turret 55 transfers the filled bottle 1 to the auxiliary tool separating means 19.

Figure 15:
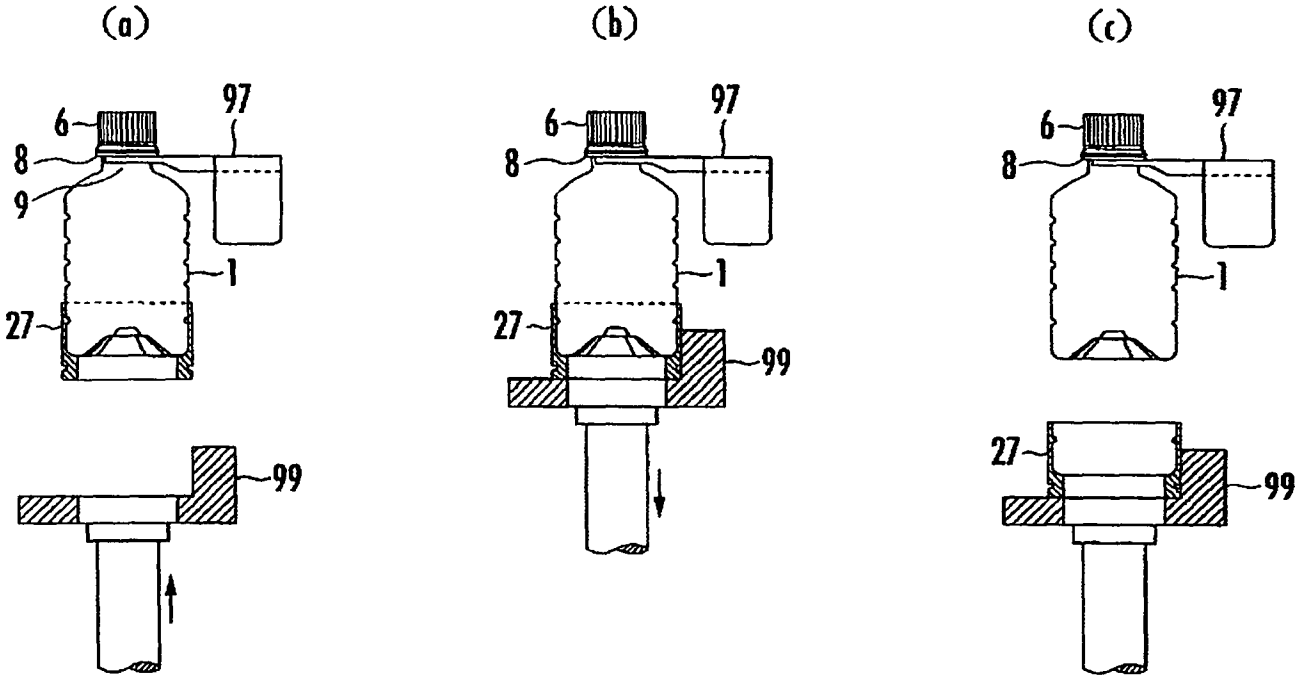
FIG. 15 is an explanatory view typically showing an auxiliary tool separating step performed by the device according to the first embodiment of the present invention.

In the auxiliary tool separating means 19, the filled bottle 1 transferred by the filled bottle transfer turret 55 is retained by the filled bottle chuck 97 as shown in FIG. 15(*a*). At this time, the filled bottle chuck 97 externally grips the neck part 9 of the filled bottle 1. Then, as shown in FIG. 15(*b*), the auxiliary tool connection member 99 is raised and connected to the auxiliary tool 27 installed on the filled bottle 1. Then, as shown in FIG. 15(*c*), the auxiliary tool connection member 99 is lowered, and the auxiliary tool 27 installed on the filled bottle 1 is lowered and separated from the filled bottle 1. Subsequently, as shown in FIG. 3, the auxiliary tool 27 is delivered to the first auxiliary tool discharge turret 60, which then discharges the auxiliary tool 27. The retention of the filled bottle 1 by the filled bottle chuck 97 is canceled. The filled bottle 1 is delivered to the filled bottle discharge turret 59, which discharges the filled bottle 1.

Now, a second embodiment of the present invention will be described.

A device according to the second embodiment produces a content filling bottle with contents such as a drink filled therein. The device according to the second embodiment comprises bottom part recessing means 217, shown in FIG. 16, as an essential part.

Although not shown in the drawings, a filler and a capper (not shown in the drawings) are disposed upstream of the bottom part recessing means 217; the filler is content filling means of a well-known configuration for filling the contents into the bottle 1 (see FIG. 1), and the capper is sealing means of a well-known configuration for sealing the bottle 1 with the cap 6.

In the second embodiment, the aseptic filling is performed, in which the sterilized liquid contents at the ordinary temperature are filled into the bottle. As is well known, a sterilization treatment device for the bottle 1 is provided upstream of the filler to set an upstream side including the capper in a sterile environment.

Figure 16:
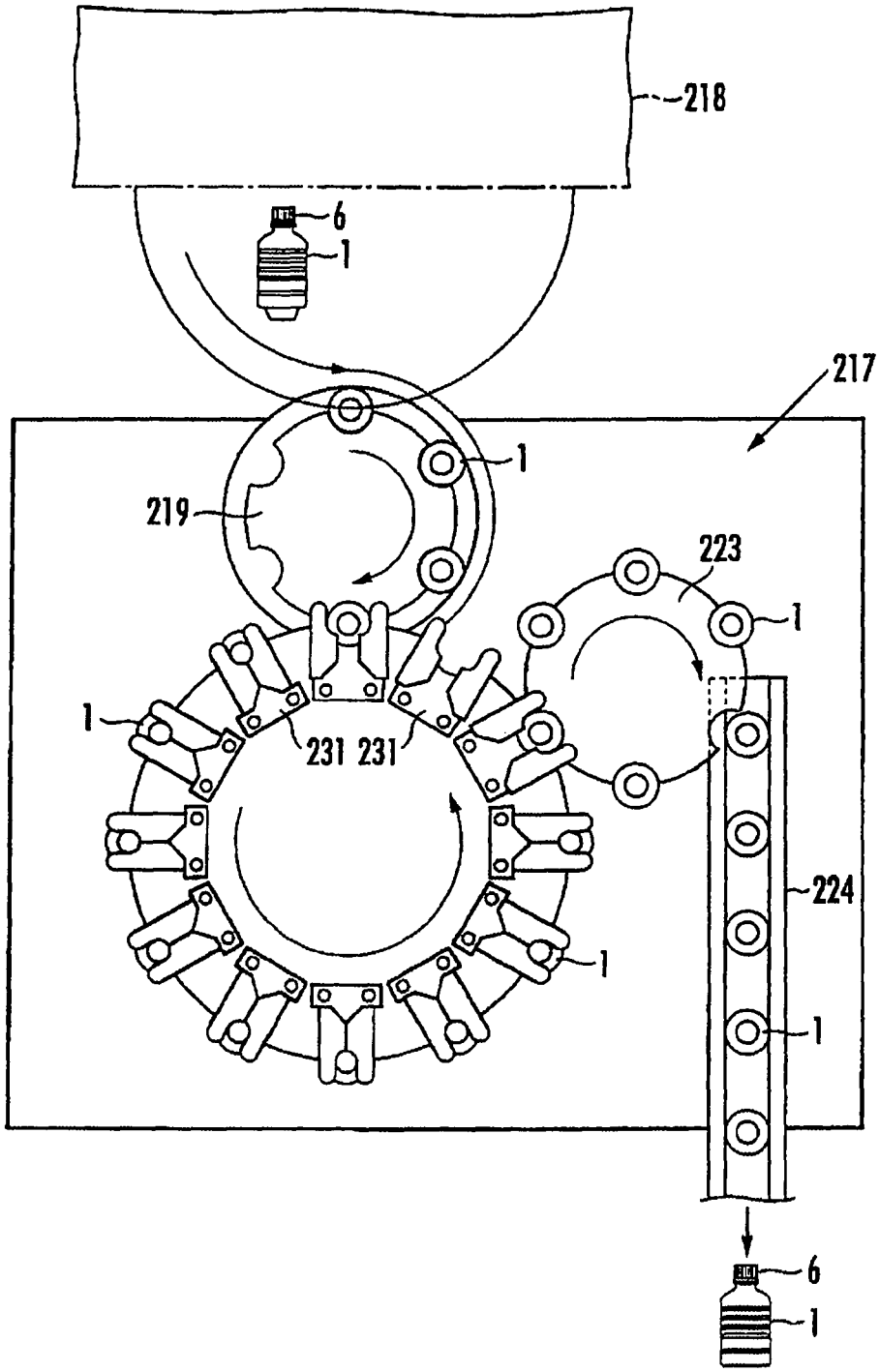
FIG. 16 is a plan view showing in outline the configuration of bottom part recessing means of a device according to a second embodiment of the present invention.

Here, a part of a discharge conduit connected to a bottle discharge side of the capper is defined by an alternate long and short dash line and shown at reference numeral 218, in FIG. 16. The discharge conduit 218 is provided taking the effects of outer air on the discharge side of the capper in the sterile environment. That is, for the aseptic filling, although not shown in the drawings, the capper is in the sterile atmosphere as described above so that devices constituting the capper are kept sterile. On the discharge side of the capper, a position where the sterile atmosphere contacts the outer air is located as far from the devices constituting the capper as possible to inhibit the outer air from mixing into the sterile atmosphere. A plurality of discharge turrets are disposed on the discharge side of the capper toward a downstream side to provide a relatively long discharge conduit 218 for the capper. Thus, the sterile atmosphere extends down to a terminal end of the discharge conduit 218, along which the plurality of discharge turrets are provided. Thus, even when the sterile atmosphere contacts the outer air on the terminal end side of the discharge conduit 218, the sterile atmosphere on a start point side of the discharge conduit 218 is prevented from being affected by the outer air. The devices constituting the capper are thus kept sterile.

Now, an essential part of the device according to the second embodiment will be described. As shown in FIG. 16, a filled bottle injection turret 219 is provided upstream of the bottom part recessing means 217 so that the bottle 1 (hereinafter referred to as the filled bottle) with the contents filled therein and with the opening 2 sealed with the cap 6 is injected into the filled bottle injection turret 219.

Figure 21:
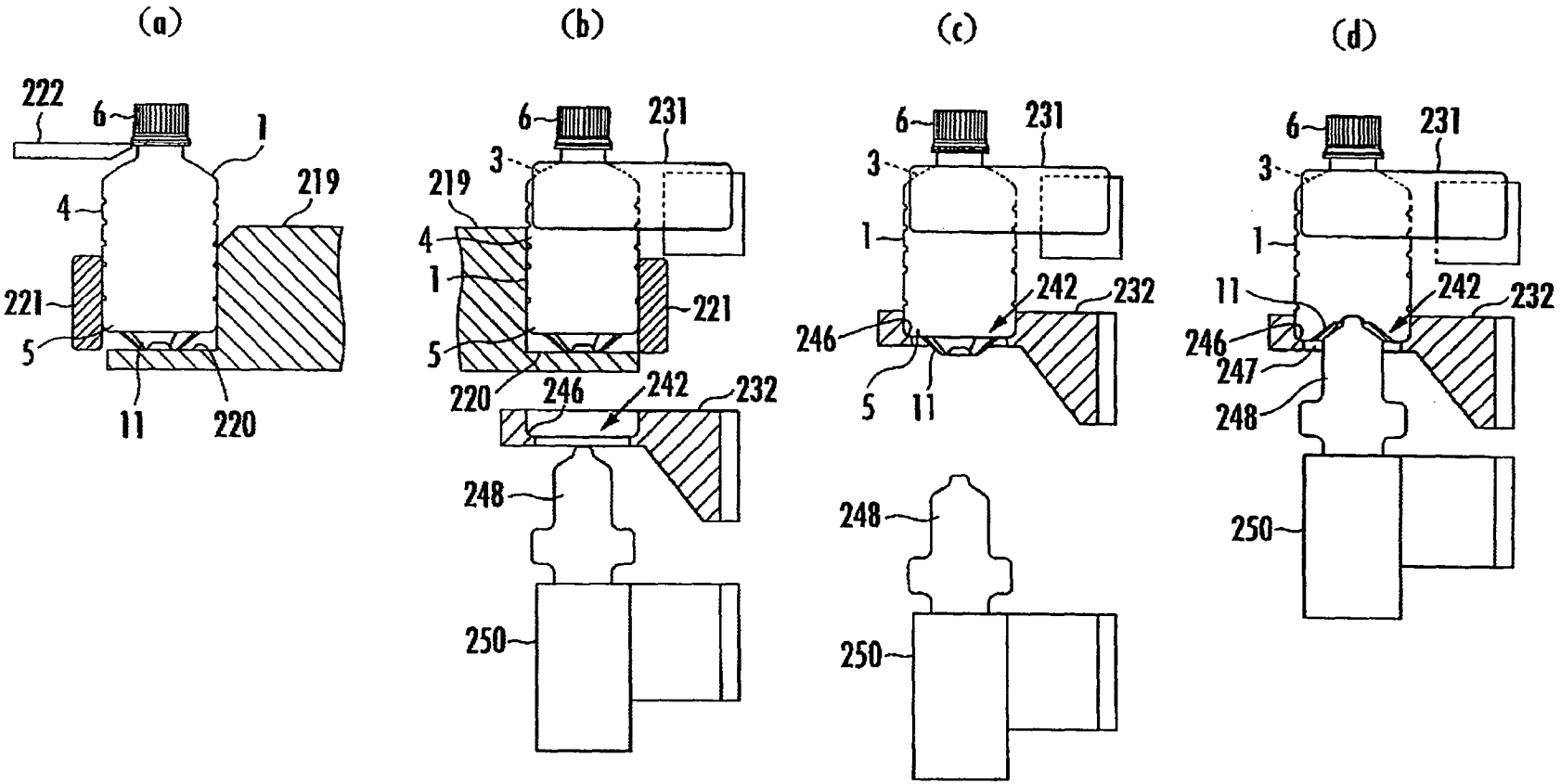
FIG. 21 is an explanatory view typically showing a bottom part recessing step performed by the device according to the second embodiment of the present invention.

As partly shown in FIG. 21(*a*), the filled bottle injection turret 219 comprises a retaining section 220, which retains the lower half of the filled bottle 1, and a regulating plate 221, which prevents the filled bottle 1 from slipping out in the retaining section 220. The filled bottle injection turret 219 injects, into the bottom part recessing means 217, the filled bottle 1 discharged through the discharge conduit 218 for the capper, not shown in the drawings, with the neck part 9 of the filled bottle 1 retained by a bottle chuck 222. A discharge turret 223 and a discharge conveyor 224, which discharge the filled bottle 1, are provided downstream of the bottom part recessing means 217.

Figure 17:
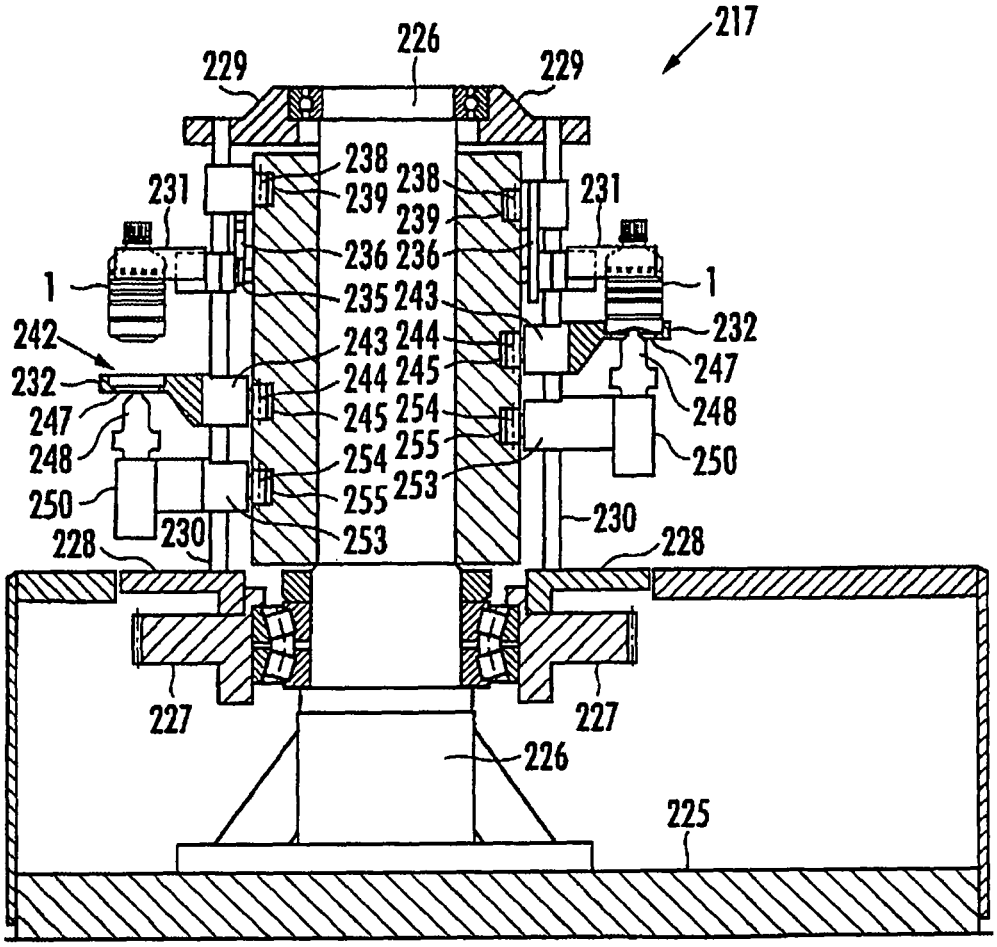
FIG. 17 is an explanatory cross sectional view showing bottom part recessing means.

As shown in FIG. 17, the bottom part recessing means 217 comprises a support pillar 226, which is disposed upright on a base 225, a drive gear 227, which is supported rotatably on the support pillar 226, and a turntable 228, which rotates integrally with the gear 227. A top panel 229 is supported rotatably on an upper end of the support pillar 226. The top panel 229 and the turntable 228 are connected together integrally by a plurality of vertically extending guide rods 230. The gear 227 is connected to rotary driving means such as a motor (not shown in the drawings).

The bottom part recessing means 217 comprises a filled bottle chuck 231 (body part gripping means), which is fixed to and supported by the guide rods 230, and a bottle support table 232 (bottom part supporting means), which is supported below the filled bottle chuck 231 by the guide rods 230 so as to be capable of being raised and lowered. The filled bottle chuck 231 and the bottle support table 232 constitute bottle retaining means according to the present invention.

Figure 18:
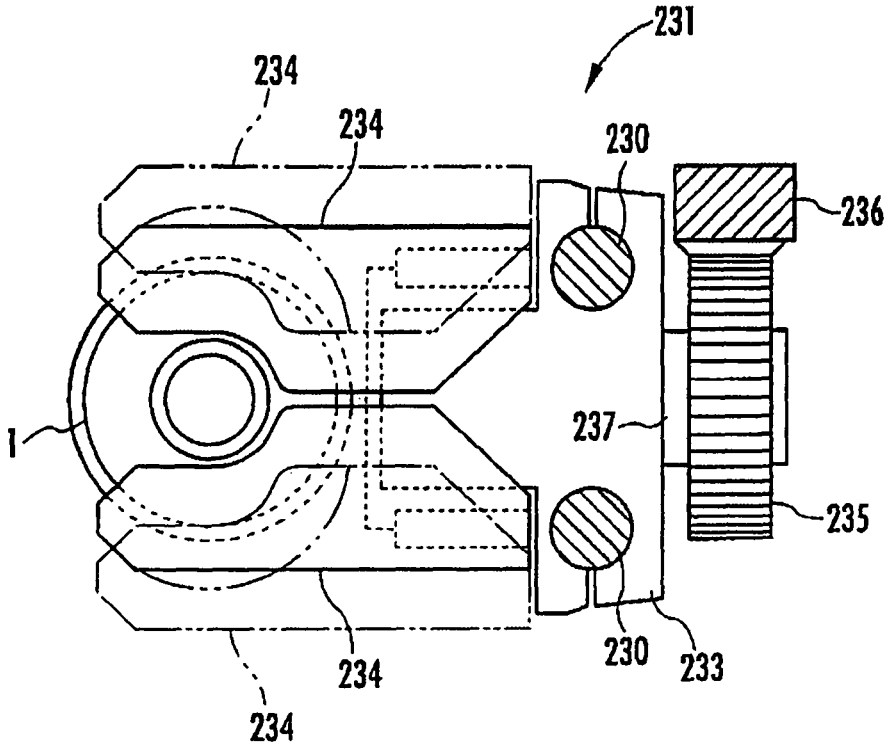
FIG. 18 is an explanatory plan view of a filled bottle chuck.

As shown in FIG. 18, the filled bottle chuck 231 comprises a base block 233, which is fixedly supported on the guide rods 230, and a pair of gripping members 234, which are openably and closably supported on the base block 233. A pinion gear 235 is disposed outside the base block 233 of the filled bottle chuck 231. As shown in FIG. 17, the pinion gear 235 meshes with a rack 236, which is disposed so as to be capable of being raised and lowered along the guide rod 230. As shown in FIG. 18, the pinion gear 235 drives an opening and closing mechanism (not shown in the drawings), which is contained in the base block 233 via a rotating shaft 237. The pinion gear 235 rotates in response to rising and lowering of the rack 236, thus opening and closing the gripping members 234. As shown in FIG. 17, the rack 236 comprises a cam follower 238, which is guided by a cam rail 239 disposed on an outer periphery of the support pillar 226, to raise and lower the rack 236.

Figure 19:
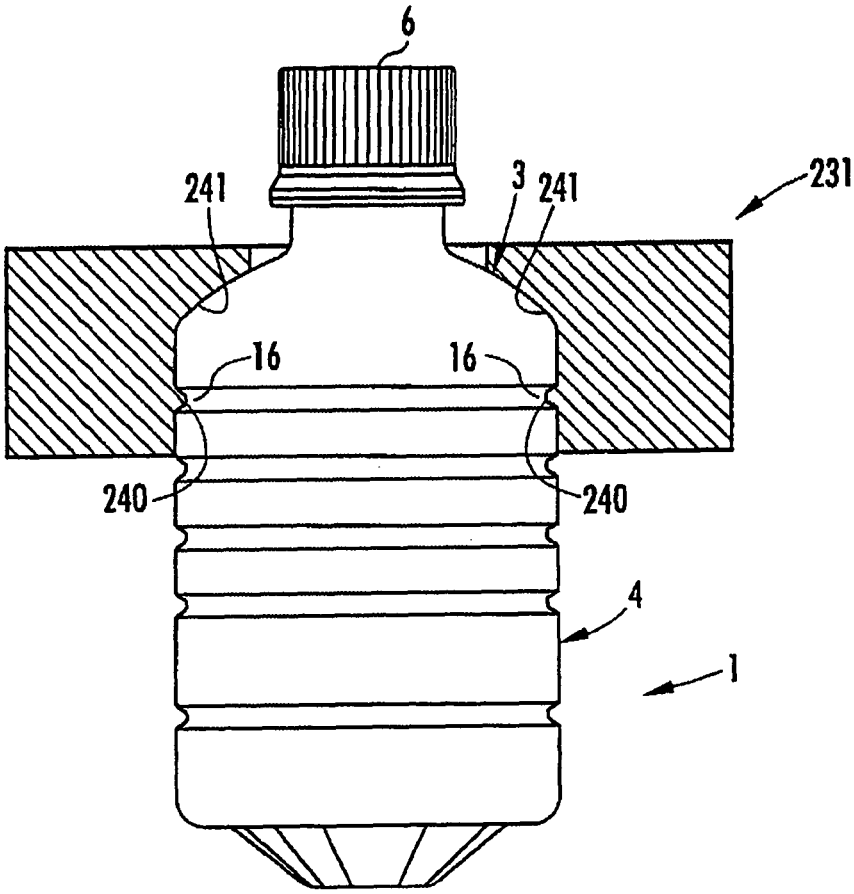
FIG. 19 is an explanatory view showing a retained state by the filled bottle chuck.

As shown in FIG. 19, the gripping members 234 of the filled bottle chuck 231 comprises an engaging convex part 240, which engages with the bead 16 located at the uppermost position on the body part 4 of the filled bottle 1. A pressing concave part 241 with a shape corresponding to the shoulder part 3 of the filled bottle 1 is formed above the engaging convex part 240. Thus, with the gripping members 234 closed, the filled bottle chuck 231 maintains a firm gripping state in which the filled bottle chuck 231 externally enclose and support the area covering the outer periphery of the body part 4 of the bottle 1 and a top surface of the shoulder part 3 of the bottle 1.

Figure 20:
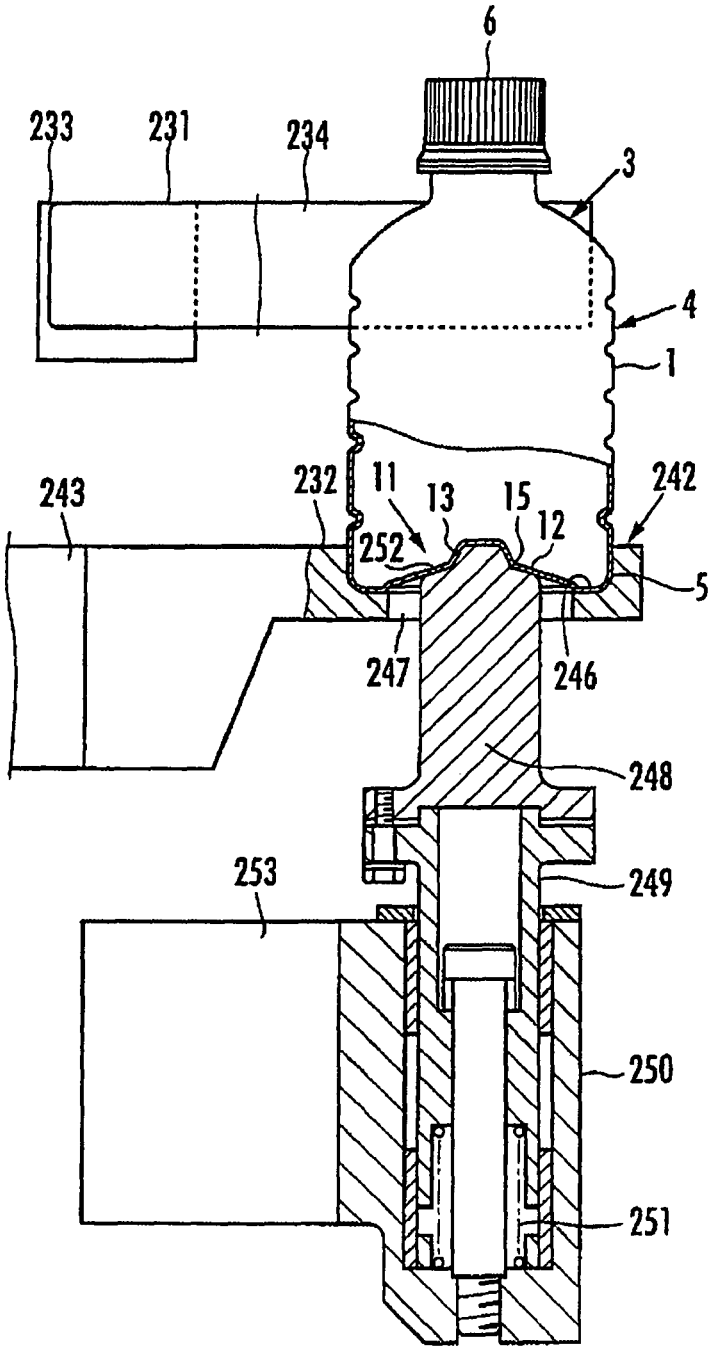
FIG. 20 is an explanatory view showing a retained state of the filled bottle in the bottom part recessing means.

As shown in FIGS. 17 and 20, the bottle support table 232 comprises a bottle loading section 242, on which the filled bottle 1 is loaded, and a raising and lowering block 243, which is supported on the guide rod 230 so as to be capable of being raised and lowered along the guide rod 230. As shown in FIG. 17, the raising and lowering block 243 comprises a cam follower 244, which is guided by a cam rail 245 disposed on an outer periphery of the support pillar 226, to raise and lower the bottle loading section 242. As shown in FIG. 20, a supporting concave part 246 and an opening part 247 are formed on the bottle loading section 242; the supporting concave part 246 corresponds to the bottom part 5 of the filled bottle 1, and a lower portion of the opening part 247 corresponding to the inversion part 11 is open. The bottle support table 232 rises toward the bottom part 5 of the filled bottle 1 retained by the filled bottle chuck 231, to load the filled bottle 1 on the bottle loading section 242.

As shown in FIG. 17, an activator punch 248 is supported on the guide rod 230 of the bottom part recessing means 217 so as to be capable of being raised and lowered along the guide rod 230. As shown in FIG. 20, the activator punch 248 is connected to an upper end of a raising and lowering shaft 249, which is retained in a guide tube 250 so as to be capable of being raised and lowered through a shock absorbing spring 251. A pushup abutment section 252 with a shape corresponding to the inclined portion 12 and inward projecting portion 13 of the inversion part 11 is formed at a tip end of the activator punch 248. As shown in FIG. 17, the guide tube 250 is connected to a slide block 253, which is slidably retained on the guide rod 230. The slide block 253 comprises a cam follower 254, which is guided by a cam rail 255 provided on an outer periphery of the support pillar 226, to raise and lower the activator punch 248. In the second embodiment, the shape of the pushup abutment section 252 is shown to correspond to the inclined portion 12 and inward projecting portion 13 of inversion part 11. However, for example, although not shown in the drawings, the pushup abutment section 252 may be shaped so as to abut peripherally against a part of the inclined portion 12.

The activator punch 248 is disposed below each of the bottle loading sections 242 of the bottle support table 232. When rotated around the support pillar 226, the activator punch 248 is guided by the cam rail 255 to rise through the opening part 247 of the bottle loading section 242. Thus, a tip end of the activator punch 248 pushes up the inversion part 11 projecting downwardly from the filled bottle 1. The inversion part 11 is thus recessed inwardly into the filled bottle 1. At this time, the shock absorbing spring 251, which is provided in the interior of the guide tube 250, prevents an excessive pushing force from the activator punch 248 from being exerted on the inversion part 11. The inversion part 11 is thus reliably prevented from being damaged. Furthermore, the pushup abutment section 252, which is provided at the tip end of the activator punch 248, enables the inversion part 11 to be reliably recessed inwardly into the filled bottle along the recessed shape thereof. The bottom part 5 can thus be reliably prevented from being inadvertently deformed, allowing the inversion part 11 to be smoothly recessed inwardly into the filled bottle. Furthermore, when the activator punch 248 pushes up the inversion part 11, the bottom part 5 of the filled bottle 1, which is regulated by the supporting concave part 246 of the bottle loading section 242, is reliably prevented from being inadvertently deformed.

With the bottom part recessing means 217, configured as described above, the adoption of the filled bottle injection turret 219 eliminates the need for a conventional conveyor that makes the filled bottle 1 self-standing during injection. Furthermore, the provision of the bottle support table 232 eliminates the need to install an auxiliary tool or the like on the bottom part 5 of the filled bottle 1 as a self-standing auxiliary tool. This in turn eliminates the need for a conventional mechanism for installing and removing the auxiliary tool, a conventional mechanism for carrying in and out the auxiliary tool, and the like. As a result, the bottom part recessing means 217 can be formed to be very compact, enabling a reduction in required installation space.

The device configured as described above according to the second embodiment produces the content filling bottle as described below. That is, although not shown in the drawings, the filler fills liquid contents into the interior of the empty bottle 1 with the inversion part 11 inversely projecting downwardly as shown in FIG. 1 (content filling step). The capper fits the cap 6 onto the opening 2 of the filled bottle 1 with the liquid contents filled therein, to seal the filled bottle 1 (sealing step). The operations in the filler and the capper are performed with the neck part 9 of the empty bottle 1 gripped and transported and without the need to make the empty bottle 1 self-standing. The filling and sealing operations can be performed without any problem even when the bottle is blow-formed such that the inversion part 11 inversely projects downwardly as shown in FIG. 1.

Then, the bottom part recessing means 217, shown in FIGS. 16 and 17, presses up the inversion part 11 projecting downwardly from the filled bottle 1, to invert and recess the inversion part 11 inwardly into the bottle 1 as shown in FIG. 20 (bottom part recessing step). First, the filled bottle 1 retained by the filled bottle injection turret 219 is injected into the bottom part recessing means 217 as shown in FIG. 21(*a*), and is gripped by the filled bottle chuck 231 for delivery, as shown in FIG. 21(*b*). After the delivery of the filled bottle 1 is completed, the bottle support table 232 is raised to load the filled bottle 1 on the bottle loading section 242 as shown in FIG. 21(*c*). Thus, the filled bottle 1 is sandwichingly held at the upper and lower positions thereof by the filled bottle chuck 231 and the bottle support table 232, respectively. The filled bottle 1 is thus positioned so as to be prevented from moving upwardly.

With the filled bottle 1 kept positioned as described above, as shown in FIG. 21(*d*), the activator punch 248 is raised to allow the tip end of the activator punch 248 to push up the projecting inversion part 11 of the filled bottle 1 so that the inversion part 11 is inwardly recessed. At this time, as shown in FIG. 20, the pushup abutment section 252 of the activator punch 248 inwardly recesses the inversion part 11 along the recessed shape thereof. Thus, the bottom part 5 can be reliably prevented from being inadvertently deformed, allowing the inversion part 11 to be inwardly recessed smoothly. Moreover, the filled bottle 1 is positioned by the filled bottle chuck 231, and the supporting concave part 246 of the bottle loading section 242 sufficiently regulates the deformation of the bottom part 5 toward the outer periphery of the bottle. Consequently, the pushup abutment section 252 of the activator punch 248 abuts accurately against the inclined portion 12 and inward projecting portion 13 of the inversion part 11. Furthermore, the inversion part 11 can be reliably inwardly recessed without inadvertently deforming the bottom part 5. Subsequently, although not shown in the drawings, the activator punch 248 is lowered below the bottle support table 232. The bottle support table 232 is then lowered and separated from the filled bottle 1, which is thus retained by the filled bottle chuck 231. Then, the retention of the filled bottle 1 by the filled bottle chuck 231 is canceled. The filled bottle 1 is thus delivered to the bottle discharge turret 223, which discharges the filled bottle 1 via the discharge conveyor 224.

In the second embodiment, the aseptic filling has been described, in which the sterilized liquid contents at the ordinary temperature are filled into the bottle. However, the hot filling may be performed, in which heated liquid contents in a high temperature state are filled into the bottle. In this case, a rinser, which washes the interior of the bottle 1, is provided upstream of the filler. For the aseptic filling, a sterilization treatment device for the bottle 1 is provided upstream of the filler.

Industrial Applicability

The present invention provides a method and device for producing a content filling bottle obtained by filling liquid contents into the interior of a synthetic resin bottle including a bottom part a portion of which is formed to project outwardly in an axial direction of a body part thereof, the projecting portion being capable of being inverted and recessed inwardly into the body part. The present invention can efficiently produce a sanitary and high-quality content filling bottle.

The invention claimed is:

1. A method for producing a content filling bottle, in which liquid contents are sealed inside a synthetic resin bottle, said bottle comprising a hollowed body part, an opening formed at an upper end of the body part and onto which a cap is capable of being fitted, a shoulder part formed below the opening on an upper portion of the body part, a bottom part closing a lower end of the body part, and an inversion part formed in a portion of the bottom part so as to project outwardly from the body part in an axial direction of the body part, the inversion part being capable of being inverted and recessed inwardly into the body part in the axial direction thereof, the method comprising:

a content filling step in which liquid contents are filled into an interior of the empty bottle with said inversion part projecting outwardly from the body part and with the contents not filled therein yet, and a sealing step in which the cap is fitted onto the opening of the filled bottle with the liquid contents filled therein in the content filling step to seal the bottle, the method further comprising:

a bottle retaining step performed after the sealing step, the bottle retaining step fitting a pair of pressing concave parts with shapes corresponding to the shoulder part of the bottle around opposite sides of the shoulder part of the filled bottle, thereby gripping the bottle so that the bottle is inhibited from moving in a vertical direction; and a bottom part recessing step in which said inversion part of the bottom part of the filled bottle retained in the bottle retaining step is pressed up so as to be inverted and recessed inwardly into the bottle.

2. The method for producing a content filling bottle according to claim 1, wherein in said bottle retaining step, the bottom part of the bottle except for the inversion part is retained simultaneously with the gripping of the shoulder part on the upper portion of the body part of the filled bottle with the cap that was previously fitted thereon in said sealing step, wherein the shoulder part on the upper portion of the body part is continuous with the opening.

3. The method for producing a content filling bottle according to claim 1, wherein in said content filling step, the contents heated to a predetermined temperature are filled into the empty bottle.

4. The method for producing a content filling bottle according to claim 1, wherein in said content filling step, the contents at an ordinary temperature are filled into the empty bottle.

5. The method for producing a content filling bottle according to claim 1, wherein the body part of the bottle includes an annual bead extending around a circumference thereof, and the bottle retaining means includes a pair of engaging convex parts formed respectively below the pressing concave parts, the pair of engaging convex parts engaging portions of an annular bead on the opposite sides of the bottle.

6. A device for producing a content filling bottle, in which liquid contents are sealed inside a synthetic resin bottle, said bottle comprising a hollowed body part, an opening formed at an upper end of the body part and onto which a cap is capable of being fitted, a shoulder part formed below the opening on an upper portion of the body part, a bottom part closing a lower end of the body part, and an inversion part formed in a portion of the bottom part so as to project outwardly from the body part in an axial direction of the body part, the inversion part being capable of being inverted and recessed inwardly into the body part in the axial direction thereof, the device comprising:

content filling means for filling liquid contents into an interior of the empty bottle with the inversion part projecting outwardly from the body part and with the contents not filled therein yet;

sealing means for fitting the cap onto the opening of the filled bottle with the liquid contents filled therein by the content filling means to seal the bottle;

bottle retaining means having a pair of pressing concave parts with shapes corresponding to the shoulder part of the bottle, the pressing concave parts fitting around opposite sides of the shoulder part of the filled bottle, in order to grip the bottle so that the bottle is inhibited from moving in a vertical direction; and bottom part recessing means for pressing up said inversion part of the bottom part of the filled bottle retained by the bottle retaining means, so as to invert and recess said inversion part inwardly into the bottle.

7. The device for producing a content filling bottle according to claim 6, wherein said bottle retaining means further comprises bottom part supporting means for supporting the bottom part of the filled bottle, the bottom part supporting means being provided below the pair of pressing concave parts, and the bottom part supporting means comprises a supporting concave part corresponding to the bottom part of the bottle and an opening part that is open in a lower bottom portion thereof corresponding to said inversion part.

8. The device for producing a content filling bottle according to claim 6, wherein said content filling means fills the contents heated to a predetermined temperature into the empty bottle.

9. The device for producing a content filling bottle according to claim 6, wherein said content filling means fills the contents at an ordinary temperature into the empty bottle.

10. The device for producing a content filling bottle according to claim 6, wherein the body part of the bottle includes an annual bead extending around a circumference thereof, and the bottle retaining means includes a pair of engaging convex parts formed respectively below the pressing concave parts, the pair of engaging convex parts engaging portions of an annular bead on the opposite sides of the bottle.

* * * * *